US012672723B2

(12) United States Patent
Wickramasekera

(10) Patent No.: US 12,672,723 B2
(45) Date of Patent: Jul. 7, 2026

(54) ELEVATED BED SYSTEM

(71) Applicant: Outlier Campers LLC, Cambridge, MA (US)

(72) Inventor: Ananda Wickramasekera, Cambridge, MA (US)

(73) Assignee: Outlier Campers LLC, Cambridge, MA (US)

( * ) Notice: Subject to any disclaimer, the term of this patent is extended or adjusted under 35 U.S.C. 154(b) by 0 days.

(21) Appl. No.: 18/794,730

(22) Filed: Aug. 5, 2024

(65) Prior Publication Data

US 2026/0033642 A1 Feb. 5, 2026

(51) Int. Cl.

| | |
|---|---|
| ***A47C 17/82*** | (2006.01) |
| ***A47C 19/04*** | (2006.01) |
| ***E04H 15/06*** | (2006.01) |
| ***E04H 15/56*** | (2006.01) |

(52) U.S. Cl.

CPC ..... *A47C 17/82* (2013.01); *A47C 19/045* (2013.01); *E04H 15/06* (2013.01); *E04H 15/56* (2013.01)

(58) Field of Classification Search

CPC ..... A47C 17/64; A47C 17/70; A47C 17/768; A47C 17/82; A47C 17/705; A47C 19/04; A47C 19/045

See application file for complete search history.

(56) References Cited

U.S. PATENT DOCUMENTS

| | | | | |
|---|---|---|---|---|
| 1,423,171 | A * | 7/1922 | Ames | A47C 17/64 5/113 |
| 4,034,518 | A * | 7/1977 | Trecker | A47C 17/82 43/109 |
| 2020/0205576 | A1* | 7/2020 | Choi | A47C 20/041 |
| 2025/0000269 | A1* | 1/2025 | Frick | A47C 19/045 |

FOREIGN PATENT DOCUMENTS

| | | | | |
|---|---|---|---|---|
| EP | 2098663 | A2 * | 9/2009 | A47C 7/666 |
| GB | 2129288 | A * | 5/1984 | A47C 1/143 |
| GB | 2409156 | A * | 6/2005 | A47C 17/70 |
| KR | 20190136750 | A * | 12/2019 | E04F 10/02 |

* cited by examiner

*Primary Examiner* — Richard G Davis
(74) *Attorney, Agent, or Firm* — SOLID STATE LAW FIRM

(57) ABSTRACT

Provided is an elevated bed system comprising a platform and one or more legs detachably connected to the platform. The legs may be configured to vary in length and may include a foot pivotably connected to each leg, enabling stable placement on various surfaces. The platform can be perforated and foldable. The system may also include configurations with multiple legs of different lengths and detachable, pivotable connections between the foot and the leg. Additionally, the system may encompass legs with portions designed to be secured to surfaces using stakes, screws, corkscrews, or combinations thereof. This versatile design allows for easy assembly, adjustment, and stability on diverse surfaces.

20 Claims, 18 Drawing Sheets

ELEVATED BED SYSTEM

CROSS-REFERENCE TO RELATED APPLICATION

This application claims the benefit of U.S. Provisional Patent Application No. 63/583,465, filed in the United States Patent and Trademark Office on Sep. 18, 2023, the entire contents of which are incorporated herein by reference.

BACKGROUND

Technical Field

The present disclosure relates generally to elevated bed systems, and more particularly to elevated bed systems with configurable platforms and legs that are detachably and pivotably connected, allowing for variation in platform perforation, foldability, and leg length. The disclosure also pertains to configurations where the legs can be secured to surfaces using various attachment mechanisms.

Background

Existing portable sleeping platforms require an even surface for all legs, require an even surface for legs in the same row, have legs in fixed positions, have lack of height adjustment options for legs, have legs and supports that take up too much space below the platform which can make gear storage beneath the platform difficult, are too cumbersome to place on or around objects (e.g., fixed cross brace supports for legs that are difficult to place around or on objects), or are too tall and restrict headroom above (e.g., inside a vehicle). Many car sleeping platforms (i.e., those intended for use inside a vehicle) may not be designed for use on vehicle rooftops (e.g., on vehicle roof racks, like rooftop tents), in pickup beds (e.g., in open truck beds with no cap, cover, or topper, as a bed tent), or outside (e.g., as a tent cot might be used) without first being placed inside a separate tent. And most tent cots (i.e., a sleeping platform combined with a tent) may be difficult to adapt for use inside a vehicle. It would be beneficial for a portable sleeping platform to be placeable inside a vehicle as well as outside (e.g., outside on the ground, in an open-air pickup bed, or on a roof of a vehicle). If placed inside a vehicle, it would be beneficial for a portable sleeping platform to be placeable over gear that may be stored in a vehicle trunk; over rigid seat backs that may or may not fold fully flat (e.g., such that they're slanted); over soft seat bottoms that may be sloped (e.g., bucket seats) or may not be sloped; directly on the floor board of a vehicle; on other rigid components of a vehicle; on rigid gear capable of supporting weight (e.g., a hard cooler); or over or on a combination of hard, soft, flat, or sloped surfaces. If placed outside, it would be beneficial for a portable sleeping platform to be attachable to a tent cover and be placeable on rigid, soft, sloped, and/or uneven surfaces. The elevated bed system described herein allows for deployment in vehicles of varying sizes and types; various deployment options in the same vehicle, depending on different seating configurations and/or cargo storage needs; deployment in other structures such as boats, cabins, houses, or other structures, or stand-alone deployment outside on various surfaces with or without a tent cover. With a plurality of height-adjustable legs that may be detachably connected to pivotable ankles and/or feet of various shapes, sizes, and configurations, and may be detachably connected to a foldable platform at various positions along the platform which may be used with or without a tent cover, the elevated bed system described herein may be deployable on or over a variety of surfaces and various types of terrain, either inside a structure or outside. Either all or a portion of the elevated bed system described herein may be deployed as shelving inside the trunk of a vehicle or elsewhere to store items both under or on it (e.g., a portion of the foldable platform and one or more detachable legs may be used to create a shelf). A properly equipped elevated bed system may take the place of a custom-built sleeping platform, a tent cot, a regular or inflatable mattress that requires a flat surface, trunk shelving, a rooftop tent, storage shelving, a platform roof rack, and/or a pickup truck bed cover and/or rack. Two elevated bed systems may be deployed, with one inside a car and other on a car, in a truck bed, or outside, for example, so that an entire family may sleep.

SUMMARY OF THE DISCLOSURE

Described herein is an elevated bed system that is portable and contains components that may be detachably and interchangeably connected to deploy the elevated bed system over hard, soft, sloped, and/or uneven surfaces; over gear or other items; and/or inside a vehicle, inside another structure, or outside. The elevated bed system described herein may be comprised of a foldable mattress platform; a foldable mattress; an assortment of adjustable-height legs attachable to the platform; an assortment of various feet for placement on various surfaces or for various applications, attachable to the legs or to the platform; ankles to allow the feet to pivot in relation to the legs for deployment on sloped or slanted surfaces, attachable between the legs and feet; clamps attachable to the legs to create cross-brace supports between legs; a tent cover to create an enclosed, elevated bed system; attachment mechanisms to detachably and interchangeably connect various components to each other and/or to the platform; and guides to aid assembly such as component placement stickers and embedded levels. The elevated bed system described herein may also be configurable for use as a platform roof rack, rooftop tent, pickup truck bed cover, pickup truck bed platform rack, or pickup truck bed tent.

The elevated bed system described herein may contain a platform that may be foldable and/or detachable into smaller sections or panels. The sections or panels may be foldable against each other by use of hinges and/or may be detachably connected by use of disconnectable hinges or other mechanisms. A platform section or panel may also contain one or more slide latches (e.g., one on each side of a section or panel) that may slide and latch across another platform section or panel to secure two sections or panels in an unfolded position or may slide and latch back into the first section or panel to allow the two sections or panels to be folded or separated. The platform of the elevated bed system may be perforated or may contain holes, notches, groves, tracks, receptables, threaded inserts, other inserts, and/or other features or a combination of features that may allow one or more legs to be detachably connected at various positions across the platform; or may allow feet to be detachably connected directly, without legs; and/or may allow a tent cover to be detachably connected. A leg may be attachable using a quick-connect mechanism that may allow the leg to be quickly attached for use, detached for storage, or repositioned for use or storage. A fixed height or adjustable-height leg may be detachably connected on one end (e.g., a top end) using a screw, bolt, nut, clamp, plunger, pin, or other attachment mechanism or a combination of attachment mechanisms to, into, or through one or more than one hole or another receptacle that may exist in the platform. The leg may be detachably connected on another end (e.g., a bottom end) to a variety of feet of various sizes and shapes (e.g., circular, square, triangular, round, pointed, or other shapes), and/or feet may contain bottom surfaces or features on bottom surfaces that are flat, textured, corrugated, ribbed, threaded (e.g., like a corkscrew), pointed, cushioned, and/or round or may contain a bracket to accommodate a variety of surfaces such as a vehicle trunk floor, vehicle floorboard, vehicle seat, vehicle roof rack, dirt, sand, or other terrain, or hard, or soft surfaces. The feet may be detachably connected to the platform without a leg in between as well, particularly where a short height is desired (e.g., a foot that is a bracket detachably connected to platform for deployment on vehicle roof rack cross bars). A pivotable ankle may be detachably connected between a leg and a foot to accommodate a surface that is sloped, slanted, or not level. A foot may be screwed directly into or onto a leg (or otherwise detachably connected) or an ankle may be screwed into or onto a leg (or otherwise detachably connected) on one end (e.g., a top end) and screwed into or onto a foot (or otherwise detachably connected) on another end (e.g., a bottom end). If more than one leg is used: each leg that is height-adjustable may be adjusted to a different height to accommodate a surface directly below it that may be at a different height from other surfaces; each leg may contain whichever foot may be necessary for secure positioning on, above, to, or around the surface directly under that leg, which may be different from the surfaces under other legs; and each leg may or may not contain an ankle, depending on whether the surface directly below that leg is slanted, sloped, or not level. More than one leg, ankle, and/or foot combination (e.g., 2 to 8 or more) may be detachably connected to the platform to create a stable, weight-bearing elevated surface that may be placed on, over, around, or between various objects such as gear, car seats, floorboards, center consoles, arm rests, or other objects that may exist inside a vehicle or inside a structure. The platform may be used as a shelf (e.g., so that objects may be placed under or on top of it), or, if combined with a mattress, may be used as an elevated bed, and if combined with a mattress and a tent cover may be used as a covered sleeping shelter. An elevated bed system may contain a mattress that is foldable into sections that are similar in length and width to the panel sections of the platform such that, when folded or separated, the mattress sections and platform sections or panels may be stored together (e.g., in a storage case). An elevated bed system may also contain a tent cover that may be detachably connected to the platform through, to, or into the holes and/or receptacles that may exist in the platform (e.g., a portion of the tent cover such as the bottom of a tent pole may be connected to, into, or through one or more than one hole or receptacle in the platform).

In some embodiments, an elevated bed system is provided. The elevated bed system includes a platform; a leg detachably connected to a side of the platform and a foot pivotably connected to the leg. The leg may be configured to vary length. The foot may be configured to be placed on a surface. The platform may be perforated. The platform may be foldable. The elevated bed system may include two legs detachably connected to the platform, each of the legs having different length. The elevated bed system may include three legs detachably connected to the platform, each of the legs having different length. The foot may be detachably connected to the leg. The foot may be pivotably connected to the leg by an ankle. The ankle may be detachably connected to the leg.

In some embodiments, another elevated bed system is provided. The elevated bed system may include a perforated platform; a leg detachably connected to a side of the perforated platform by an attachment on the other side of the perforated platform; and a foot pivotably connected to the leg. The foot may be detachably connected to the leg. The foot may be configured to be placed on a surface. The perforated platform may be foldable. The elevated bed system may include two legs detachably connected to the platform, each of the legs having different length. The elevated bed system may include three legs detachably connected to the platform, each of the legs having different length. The foot may be detachably connected to the leg. The foot may be pivotably connected to the leg by an ankle.

In some embodiments, another elevated bed system is provided. The elevated bed system includes a platform and a leg detachably connected to a side of the platform. The leg is configured to vary length, and the leg comprises a portion configured to be stuck to a surface. The portion may be selected from the group consisting of a stake, screw, corkscrew, and a combination thereof. The platform may be perforated. The platform may be foldable. The portion may be pivotably connected to the leg. The portion may be detachably connected to the leg.

Figure 1:
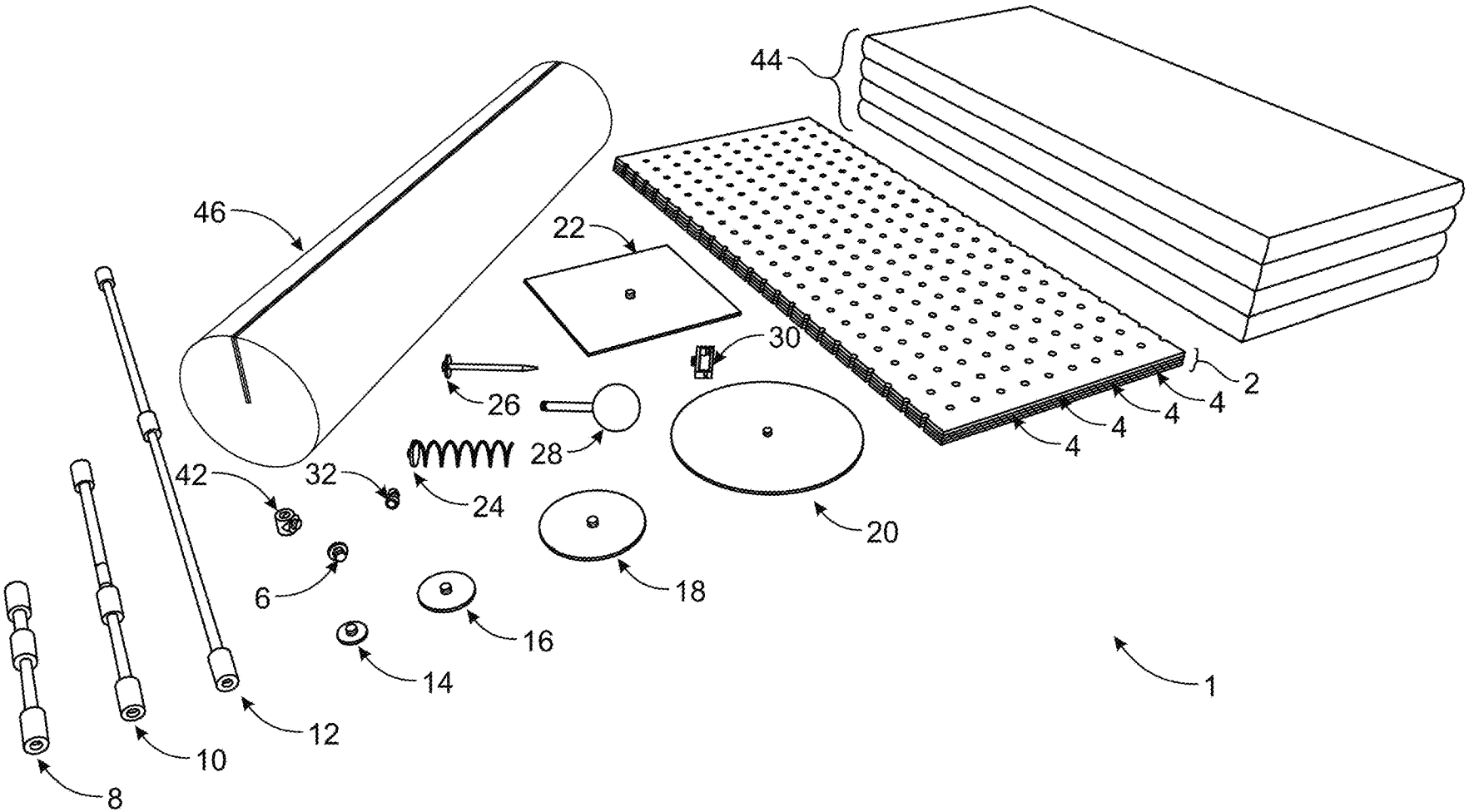
FIG. 1 shows a perspective view of the exemplary components of an exemplary elevated bed system in an unassembled configuration.

While the disclosure is susceptible to various modifications and alternative forms, specific embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION OF SPECIFIC EMBODIMENTS

Described herein are devices, components, assemblies, systems, methods, etc. for elevated bed systems. The description and accompanying figures, which describe and show certain embodiments, are made to demonstrate, in a non-limiting manner, several possible configurations of elevated bed systems, apparatuses, components, assemblies, systems, etc. and various methods of using them according to various aspects and features of the present disclosure. Accordingly, the disclosure is not limited to the specific embodiments described. Rather, the inventive principles associated with the embodiments described herein, including with respect to the apparatuses, devices, components, assemblies, systems, methods, etc. described herein, may be applied in a variety of ways, including to other types of apparatuses, devices, components, assemblies, systems, methods, etc. General and specific apparatuses, devices, components, assemblies, systems, methods, etc. are described herein sufficiently to enable one to develop a variety of implementations/applications without undue experimentation. In the development of particular applications, numerous implementation-specific decisions will be made to achieve the design-specific goals, which will vary from one implementation/application to another. It will be appreciated that, having access to this disclosure and reading this disclosure, such a development effort would be a routine undertaking for persons of ordinary skill in the art.

This document does not intend to distinguish between components that differ in name but not function. In the following discussion and in the claims, the terms "including," "includes." "comprising," "have," and "has" are used in an open-ended fashion, and thus should be interpreted to mean "including, but not limited to." The word "or" is used in the inclusive sense (i.e., "and/or") unless a specific use to the contrary is explicitly stated.

Elevated bed system 1 may be configured as a portable bed system that may be assembled for use over a variety of surfaces (e.g., flat, uneven, sloped, slanted, soft, or hard surfaces), both inside (e.g., inside a vehicle or other structure) or outside (e.g., with or without a tent cover) or dissembled for storage and transport. FIG. 1 shows exemplary components of elevated bed system 1 in an unassembled configuration which may be later assembled to configure elevated bed system 1 for use as an elevated bed as later shown in FIGS. 11-14, 16, and 18.

As shown in FIG. 1, elevated bed system 1 may consist of platform 2, which may be a platform that may further consist of one or more of foldable or detachable section 4, which may contain a plurality of holes and/or receptacles capable of accepting screws, nuts, and/or other attachment mechanisms to detachably and interchangeably connect legs, feet, tent poles or other tent components, and/or other attachments to platform 2. Holes of section 4 may be round, square, triangular, or another shape, and may have a portion that is inset (or recessed), where each shape or feature may offer certain benefits over other shapes or features. For example, non-round hole shapes may allow a screw or other attachment mechanism inserted into it to be prevented from turning when an attachment is screwed onto that screw, whereas a round hole may be compatible with a wider variety of attachment mechanisms and may be easier to produce. A recess in the holes may further allow the head of a screw or other attachment mechanism to sit flush with the surface of a platform such that it is not felt through a mattress that may rest on the upper surface of the platform, or a screw or other attachment mechanism may contain a flat head that may not protrude much, if at all, from the platform surface, if the hole is not recessed. Section 4 of platform 2 may be comprised of metal, such as aluminum, or other metal; plastic; carbon fiber; fiberglass; other composite material; other material, or a combination of materials capable of supporting enough weight for use as a bed platform. Section 4 of platform 2 may be configured to be about 24 inches wide, give or take a few inches; 36 inches wide, give or take a few inches; 40 inches wide, give or take a few inches; 48 inches wide, give or take a few inches; 54 inches wide, give or take a few inches; 60 inches wide, give or take a few inches; or 76 inches wide, give or take a few inches to accommodate a variety of standard mattress sizes and to be able to fit into various types of vehicles and/or other structures. If platform 2 is foldable or separable into four sections 4, each section 4 may be about 18.50 to 18.75 inches deep, give or take a few inches; or about 20 inches deep, give or take a few inches. If section 4 is about 18.50 to 18.75 inches deep, give or take a few inches, four sections, when unfolded or combined, may create a platform that is about 74 to 75 inches long, give or take a few inches, which may be long enough to support a common mattress length of about 74 to 75 inches. If section 4 is about 20 inches deep, give or take a few inches, four sections, when unfolded or combined, may create a platform that is about 80 inches long, give or take a few inches, which may be long enough to support another common mattress length of about 80 inches. Alternatively, three sections that are about 20 inches deep, give or take a few inches, may be either combined with one smaller section that is about 15 inches deep, give or take a few inches, to create a 75 inches long platform, give or take a few inches; or combined with another about 20 inch deep section, give or take a few inches, to make an 80 inch long platform, give or take a few inches. Section 4 of platform 2 may also contain additional features and components to guide assembly of elevated bed system 1 such as stickers 34 and 36, bubble level 38, and latch 40, as later shown in FIGS. 5-8, and described in further detail below. One or more sections may be deployable as shelving (e.g., storage in a vehicle trunk).

Figure 3:
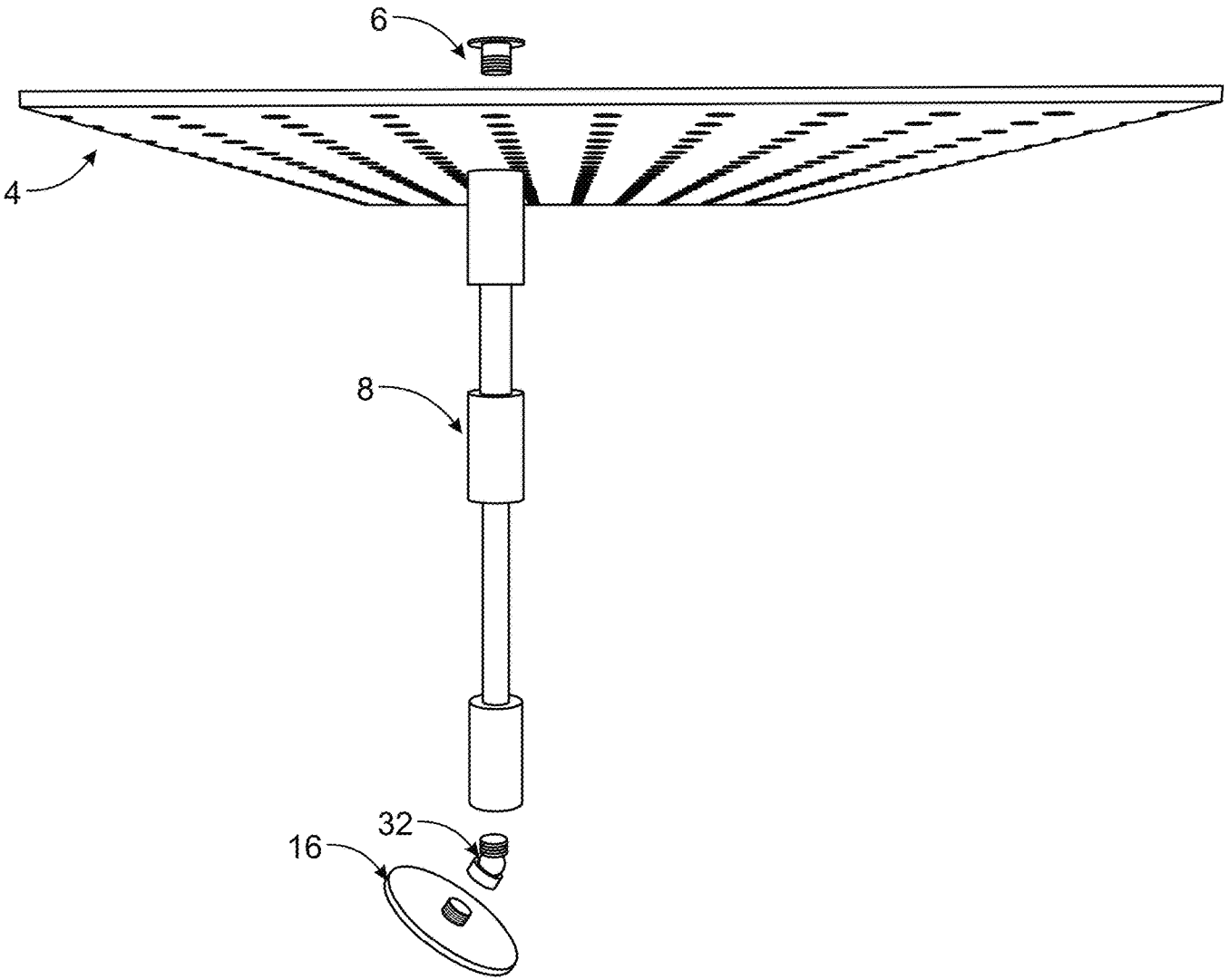
FIG. 3 shows perspective view of a leg in transition of being detachably connected to a platform section by a screw, and an ankle in transition of being detachably connected between the leg and a foot to transition the exemplary elevated bed system of FIG. 1 from an unassembled configuration to an assembled configuration.
Figure 4:
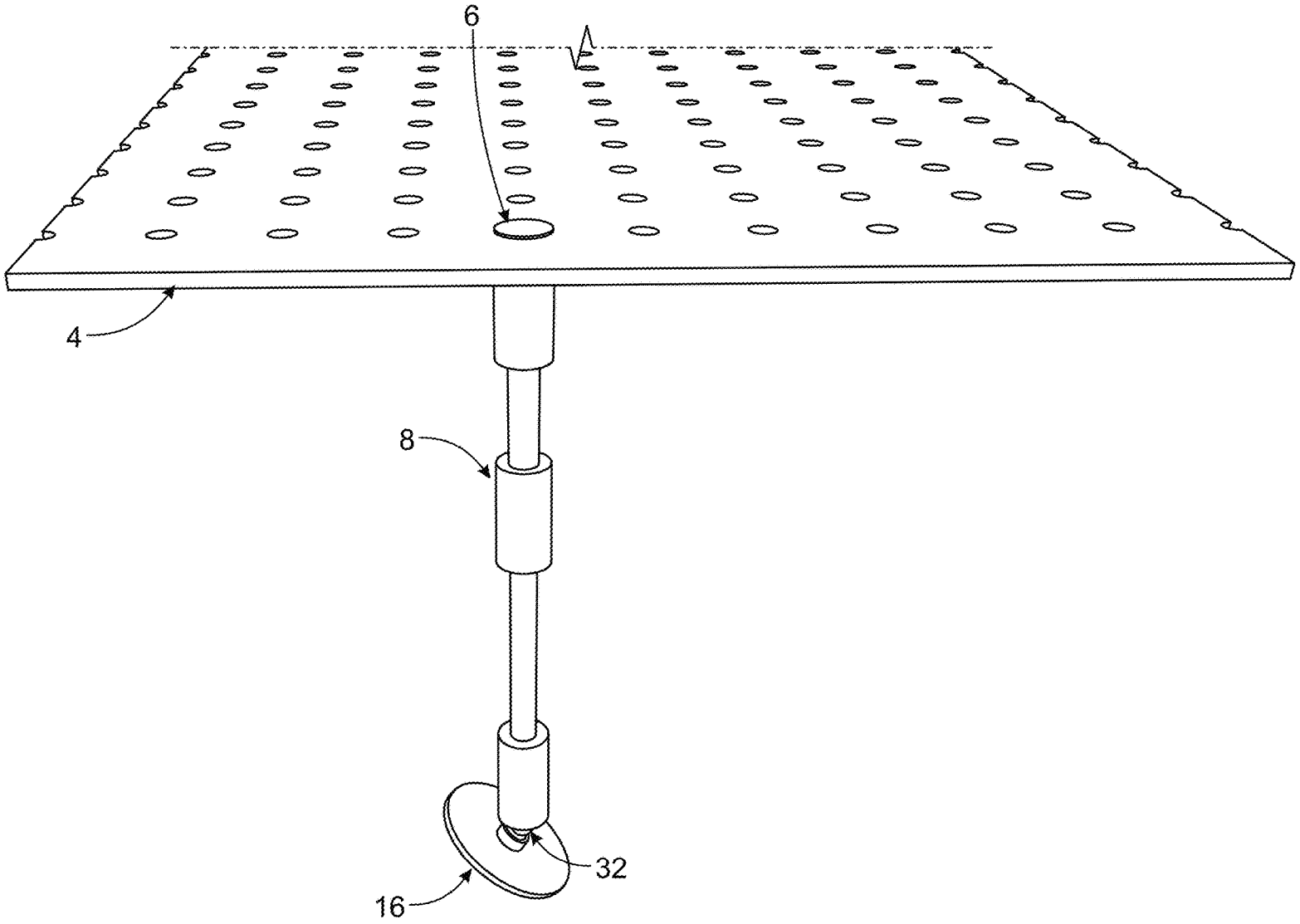
FIG. 4 shows a perspective view of the screw, platform section, leg, ankle, and foot of the exemplary bed system of FIG. 3 in an assembled configuration.
Figure 13:
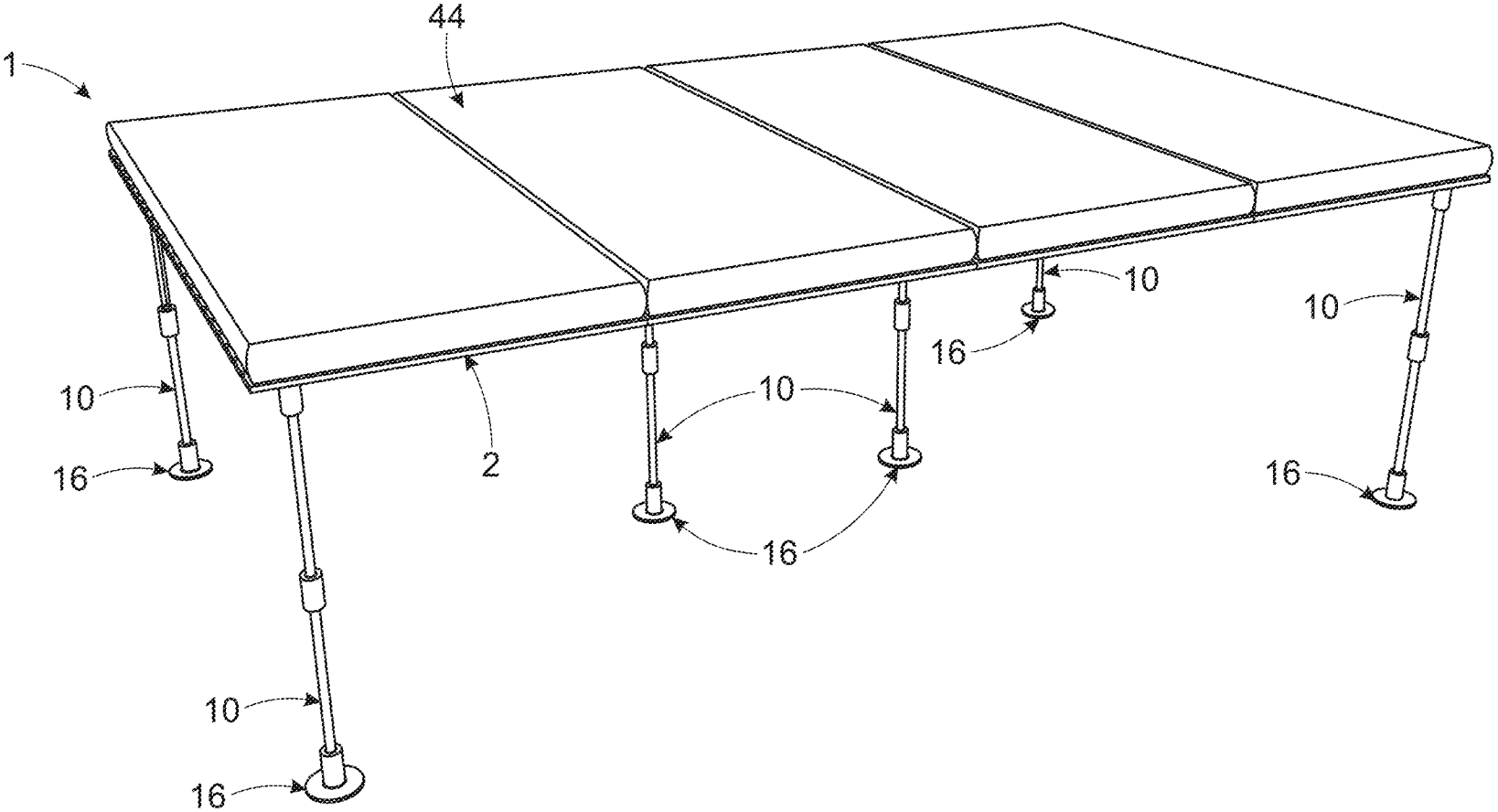
FIG. 13 shows a perspective view of an exemplary elevated bed system with legs and feet configured to be deployed over a relatively flat surface.
Figure 14:
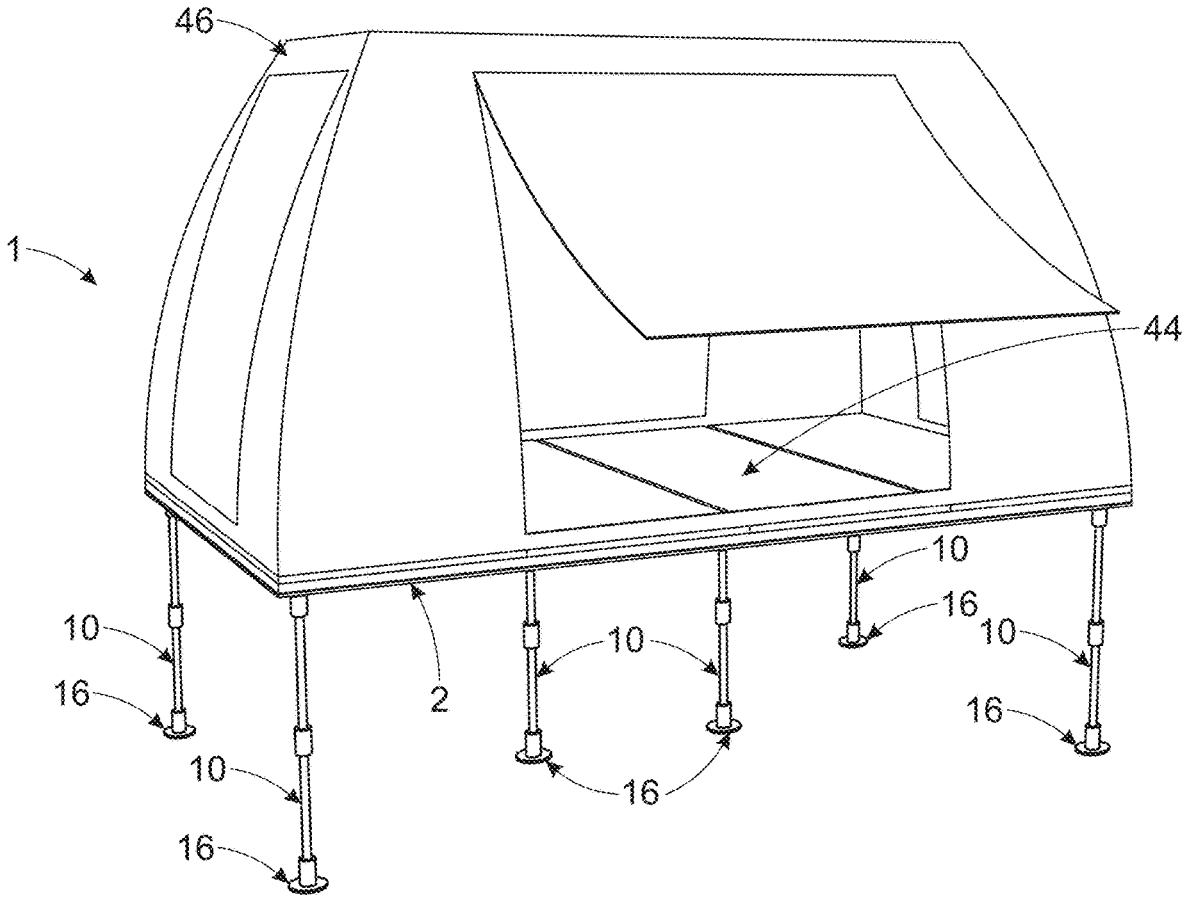
FIG. 14 shows a perspective view of the exemplary elevated bed system of FIG. 13 configured as a tent cot.
Figure 16:
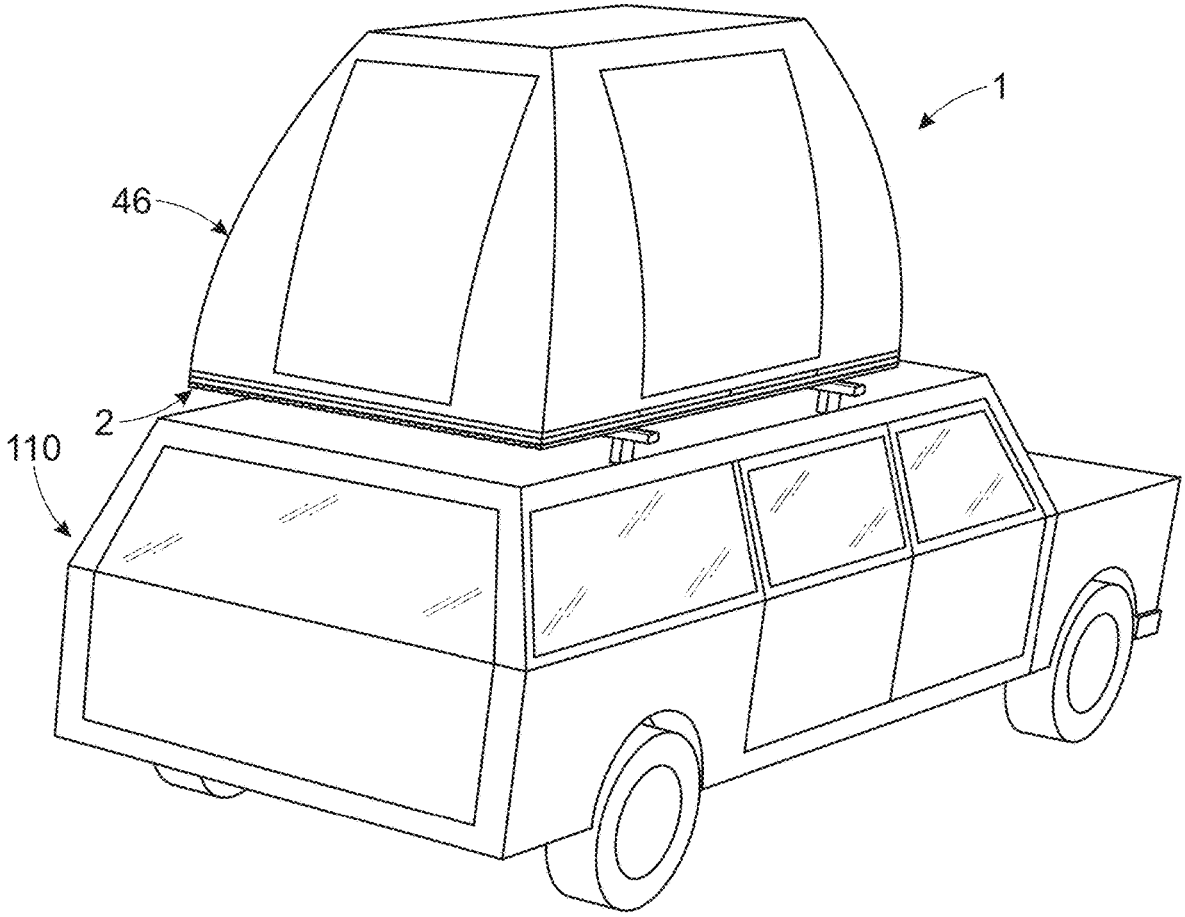
FIG. 16 shows a perspective view of the exemplary elevated bed system of FIG. 15 configured as a rooftop tent deployed on the exemplary SUV of FIG. 15.
Figure 17:
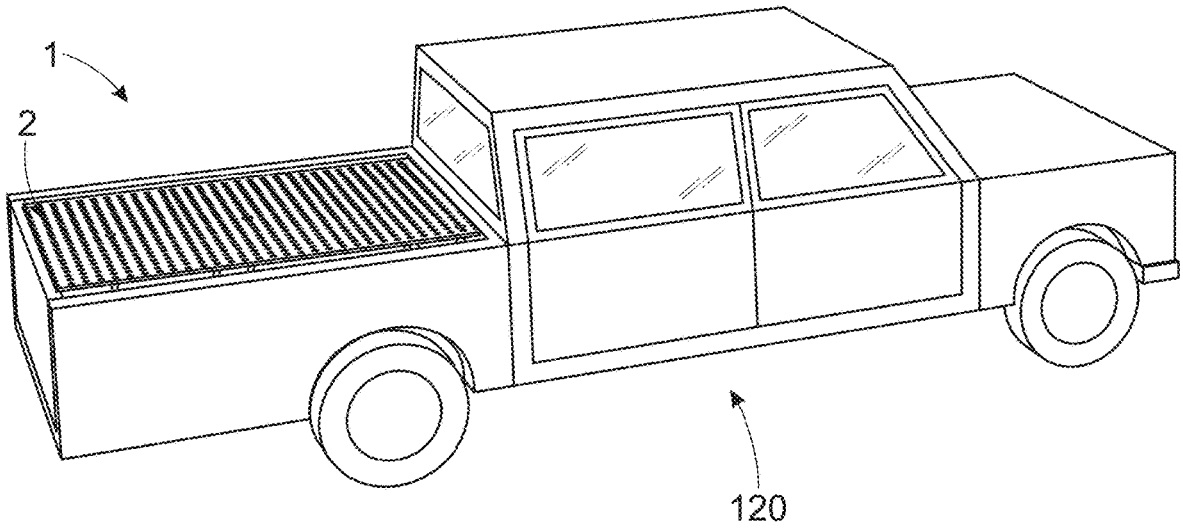
FIG. 17 shows a perspective view of an exemplary elevated bed system configured as a bed cover and/or bed rack on an exemplary pickup truck.
Figure 18:
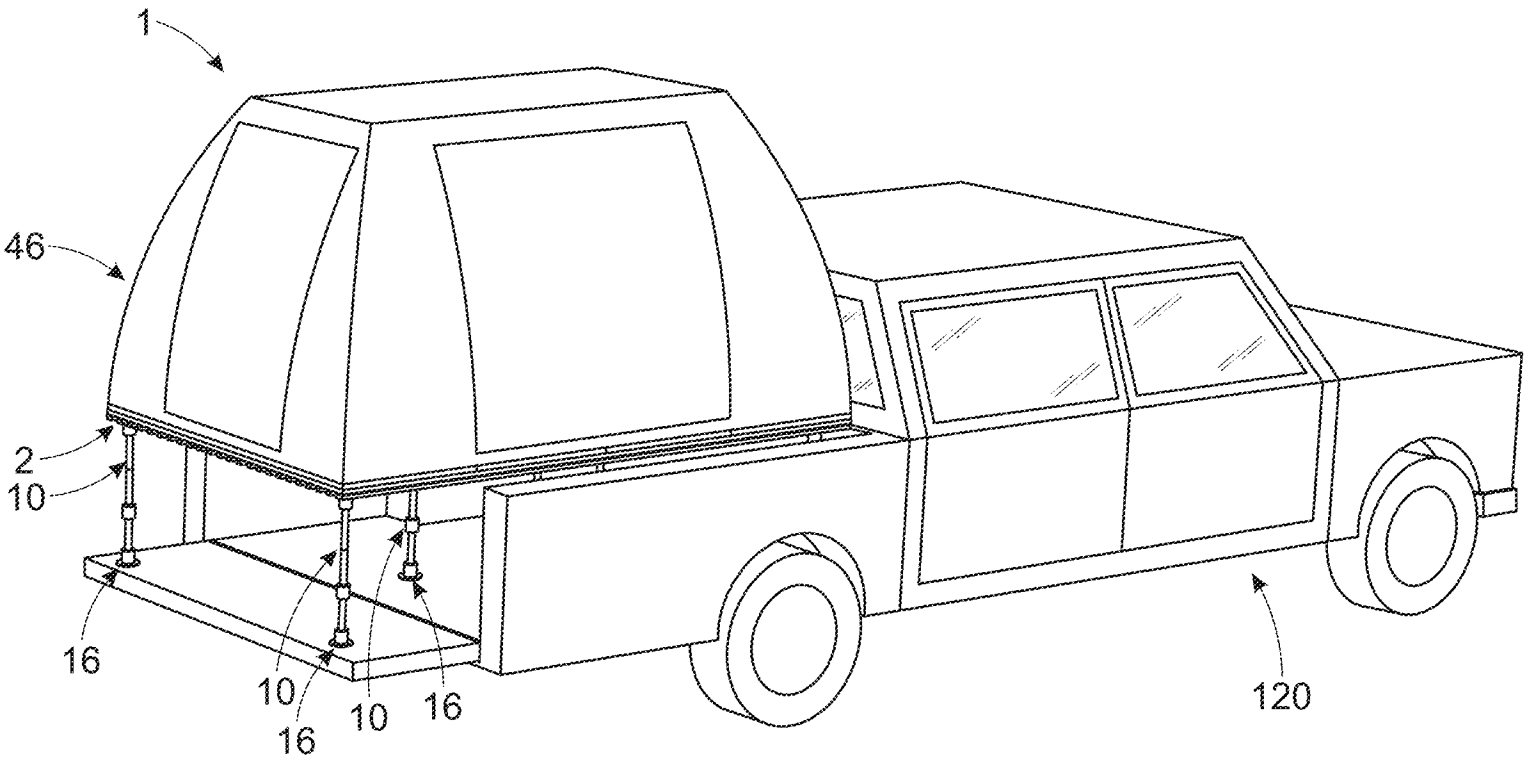
FIG. 18 shows a perspective view of the exemplary elevated bed system of FIG. 17 configured as a pickup bed tent on the exemplary pickup truck of FIG. 17.

FIGS. 1, 3, 4, and 10 further show screw 6, which may be a hand screw, cap screw, other screw, bolt, female threaded insert, retractable plunger, retractable collar, retractable pin, and/or other attachment mechanism that may be used to connect to corresponding components detachably and interchangeably in an assortment of legs, feet, tent poles, and/or other attachments. Screw 6 may be comprised of aluminum, steel, other metal, plastic, composite material, or a combination of materials. Screw 6 may be used to connect detachably and interchangeably one or more of section 4 in platform 2 to: legs 8, 10, or 12, as shown by way of example in FIGS. 3, 4, 10-12; feet 14, 16, 18, 20, 22, 24, 26, 28, and 30; tent poles or other tent components; and/or other components. As shown in FIGS. 3 and 4, screw 6 may have a threaded portion capable of being inserted into or through holes in sections 4 of platform 2 and a flat portion, its head, that may not be capable of passing through the holes in sections 4 such that anything attached to or by the screw (e.g., on the opposite side of the platform) would cause it to be securely connected to the platform. Screw 6 may be inserted through the top of section 4 to detachably connect a component (e.g., legs and/or feet) to the bottom of section 4 (as shown in FIGS. 3, 4, and 10-18); and/or screw 6 may be inserted through the bottom of section 4 to detachably connect a component (e.g., tent poles or other tent components) to the top of section 4 (as shown in FIGS. 14, 16, and 18).

Legs 8, 10, and 12, as shown in FIG. 1, may each be height-adjustable legs capable of being adjusted to various heights. Leg 8 may be a short leg capable of adjustment from 6 to 12 inches tall, give or take a few inches; leg 10 may be an intermediate-height or medium-height leg capable of adjustment from 12 to 24 inches tall, give or take a few inches; and leg 12 may be a tall leg capable of adjustment from 24 to 48 inches, give or take a few inches. By way of example, one of each of legs 8, 10, and 12 is shown in FIG. 1 however, elevated bed system 1 may contain a plurality of each type of leg, for example elevated bed system 1 may contain 1 to 8, or more or less, of legs 8, 10, and 12. Alternatively, elevated bed system 1 may contain fixed-height or other types of adjustable-height legs. Legs 8, 10, and 12 may each be further detachably and interchangeably connected to an assortment of feet, feet 14, 16, 18, 20, 22, 24, 26, 28, and 30; or to ankle 32, shown in FIG. 1. As shown in FIG. 1, legs 8, 10, and 12 may each contain a threaded insert or nut turn-able by a first hand grip at the upper end of legs 8, 10, and 12, respectively, which may be screwed onto screw 6. A second and intermediary hand grip on each of legs 8, 10, and 12, as shown in FIG. 1, may contain a clamping or adjustment mechanism that may be loosened to adjust the height (e.g., by allowing nested sections to extend or retract) of legs 8, 10, and 12, respectively, and tightened to lock in the desired height. A third hand grip at the lower end of each of legs 8, 10, and 12, as shown in FIG. 1, may contain another threaded insert or nut which may be used to detachably connect it to feet 14-30 and/or ankle 32, or may serve as foot itself if the leg is not detachably connected to another foot. Legs 8, 10, and 12 may be comprised of aluminum, steel, other metal, plastic, foam (e.g., particularly for the hand grips), rubber (e.g., particularly for the hand grips), carbon fiber, fiberglass, other composite material; other material; or a combination of materials.

Feet 14-30 may each be detachably and interchangeably connected to a lower portion of each of feet 8-12, respectively, by screwing the foot into or onto the leg. As shown in FIG. 1, each of feet 14, 16, 18, 20, 22, 24, 26, 28, and 30 may contain a threaded screw or bolt in its upper portion which may screw into a threaded insert on the bottom of legs 8, 10, and 12, respectively, or the bottom of legs 8, 10, and 12, respectively, may contain a threaded insert capable of being screwed onto a threaded screw or bolt on feet 14, 16, 18, 20, 22, 24, 26, 28, and 30. Or the feet and legs may be detachably and interchangeably connected using a variety of other mechanisms, such as retractable and/or spring plungers and/or pins, or retractable and/or spring collars and/or pins, or other types of connecting mechanisms. Alternatively, each of feet 14-30 may be detachably and interchangeably connected to one of legs 8, 10, or 12 through an intermediary component, ankle 32, which may allow the foot to pivot at an angle relative to the leg, or each of feet 14-30 may be detachably and interchangeably connected to section 4 of platform 2 by a screw 6 (e.g., if screw 6 is a threaded insert or by use of a female to female adapter, if both screw 6 and each of feet 14-30 contain or are a screw or bolt) for lower height applications of elevated bed system 1, without the use of legs. Feet 14, 16, 18, 20, 22, 24, 26, 28, and 30, as shown in FIG. 1 may each be suitable for specific surfaces or may fit onto or into specific spaces. Foot 14 may be a small, round foot; foot 16 may be an intermediate or medium-sized, round foot; foot 18 may be large, round foot; and foot 20 may be an extra-large, round foot. Round feet 14-20 may be placed on hard or soft surfaces with the larger feet being more suitable for softer surfaces (e.g., car seat bottoms, snow, or sand, etc.) by causing weight to be distributed over a greater surface area thereby reducing sinking into soft surfaces, and smaller feet may be more suitable where the available or usable surface area to place feet is limited (e.g., small center consoles, vehicle trunk filled with items, vehicle floorboard etc.). As also shown in FIG. 1, foot 22 may be a square foot that, like the round feet, may come in various sizes for various surfaces. Foot 24 may be a foot with a screw or corkscrew on its lower portion, as shown in FIG. 1, that may be suitable for insertion into surfaces such as dirt, sand, ice, hard-packed snow, or similar surfaces and may be able to securely anchor the foot (and anything directly or indirectly connected to the foot). Foot 26 may contain a spike on its lower portion, as shown in FIG. 1, that may also be able to anchor the foot (and anything directly or indirectly connected to it) into dirt, sand, ice, hard-packed snow, or other similar surfaces. Foot 28 may be a foot with a ball on its lower portion, as shown in FIG. 1, that may be suitable for shallow burial in surfaces such as soft dirt, mud, sand, snow, or other similar surfaces thereby anchoring it and anything directly or indirectly connected to it to that surface, or it may simply be placed on hard surfaces. Foot 30 may be configured as a bracket attachable to roof rack cross bars or other surfaces, securing it (and anything directly or indirectly connected to it) to that surface or component. Feet 14-30 may be comprised of a variety of materials for a variety of purposes such as metal, plastic, rubber, composite material, or a combination of materials. By way of examples, as shown in transition of being connected in FIG. 3 and shown connected in FIGS. 4, and 10-18, a plurality of feet may be detachably connected either to a plurality of legs or directly to a platform for various surfaces and/or applications.

Figure 11:
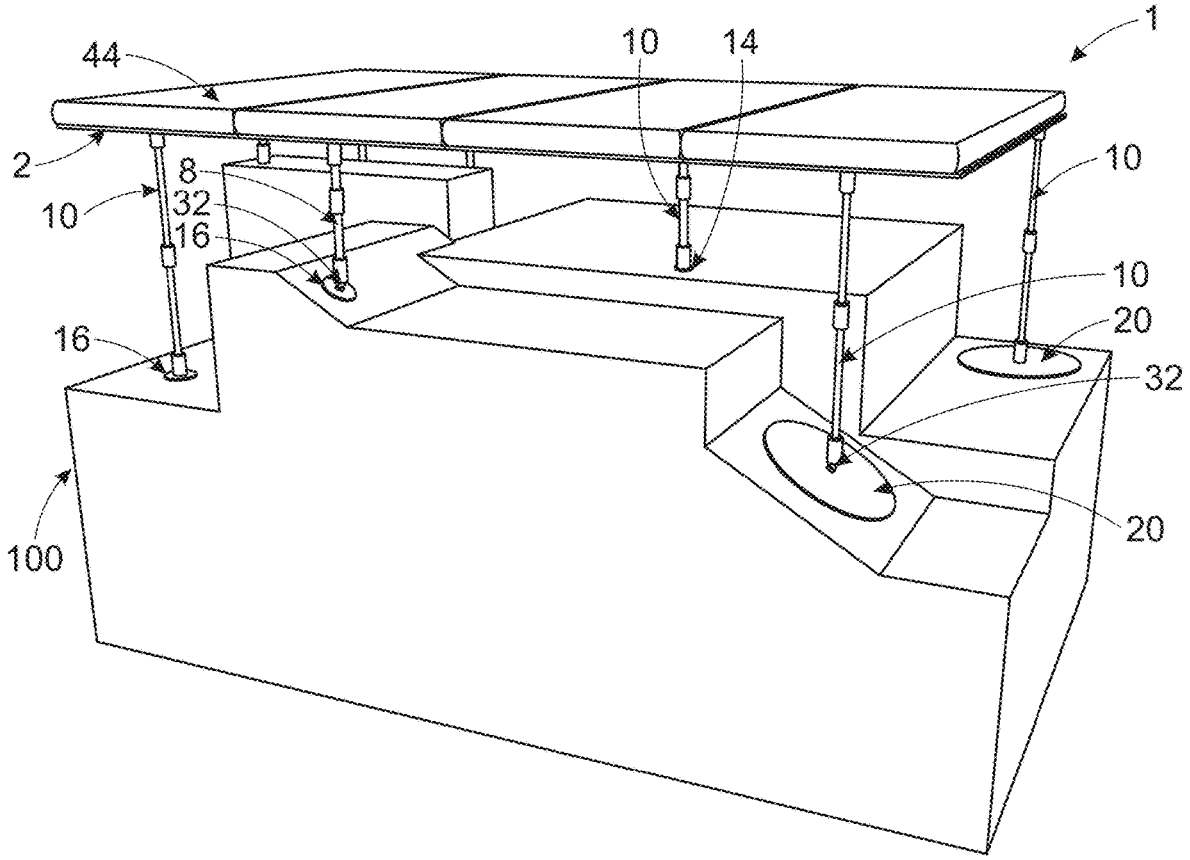
FIG. 11 shows a left, front perspective view of an exemplary elevated bed system deployed over an exemplary surface.

As mentioned earlier, Ankle 32, shown in FIG. 1, may be an ankle detachably connected between any of legs 8, 10, and 12 and any of feet 14, 16, 18, 20, 22, 24, 26, 28, and 30. When connected between a leg and a foot, ankle 32 may allow any of feet 14-30 to pivot at various angles allowing the foot to be placed on a sloped or slanted surface (e.g., a vehicle seat back that does not fold fully flat or a vehicle seat bottom that is sloped, like a bucket seat, etc.). Ankle 32 may be screwed into/onto the bottom of any of legs 8-12 and into/onto the top of any of feet 14-30 or may be detachably connected using a retractable and/or spring plunger and/or pin, a retractable and/or spring collar and/or pin, and/or another attachment mechanism. Ankle 32 may contain a ball at its center, as shown in FIGS. 1, 3, and 4 that may allow pivoting and may be tightenable to lock in an angle. Ankle 32 may be comprised of metal, plastic, composite material, or a combination of materials. By way of example, ankle 32 is shown in transition of being detachably connected to leg 8 and foot 16 in FIG. 3 and shown detachably connected to leg 8 and foot 16 in FIG. 4. FIG. 11 shows a plurality of ankles 32 used to connect a plurality of feet to legs to account for various portions of surfaces that may be sloped at various angles.

Figure 2:
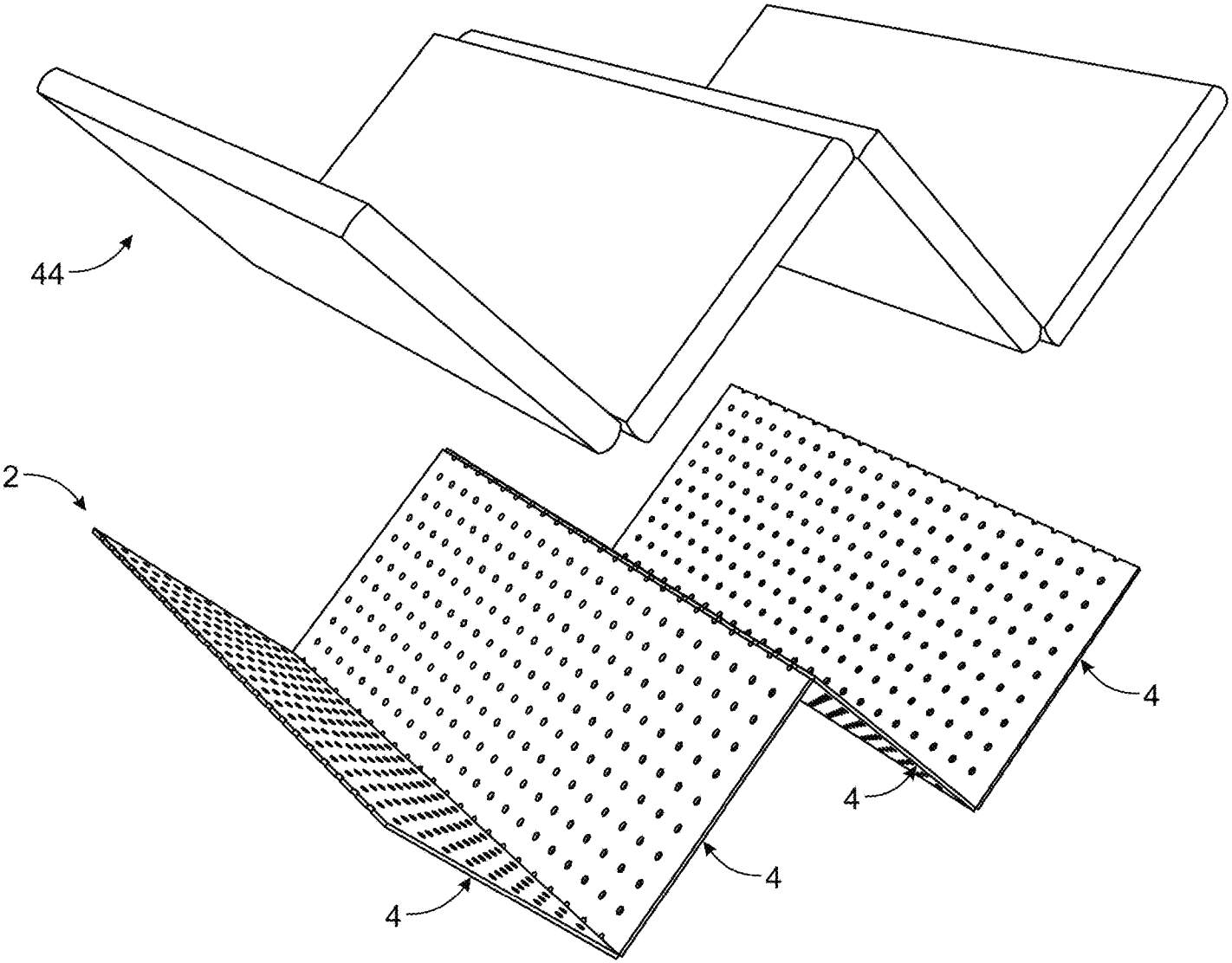
FIG. 2 shows a perspective view of a mattress and platform of the exemplary elevated bed system of FIG. 1 in transition of being unfolded.

To assemble elevated bed system 1 for use, one or more of section 4 of platform 2 may be unfolded, as shown in transition in FIG. 2. As shown in FIGS. 1-8, 10, 15, and 17, and as mentioned previously, each section 4 of platform 2 may be perforated or may contain receptacles where a combination of screws and legs; screws, legs, and feet; screws, legs, feet, and ankles; and/or screws and feet (e.g., without legs) may be detachably and interchangeably connected; and/or some portion or all of a section 4 of platform 2 may rest directly on a sturdy surface (e.g., a vehicle center console, a seat back, a seat bottom, a cooler, etc.). An example of how a leg, panel section, ankle, and foot may be detachably connected is shown in FIGS. 3 and 4. As shown in transition in FIG. 3, screw 6 may be placed through a hole in section 4 such that leg 8, which may contain a threaded insert or nut turn-able by a first hand grip at the upper end of leg 8, may be screwed onto it. A second and intermediary hand grip on leg 8, as shown in FIGS. 3 and 4, may be loosened to adjust the height of leg 8 and tightened to lock in the desired height. A third hand grip at the lower end of leg 8 may contain another threaded insert or nut which may be used to detachably connect it to ankle 32, which may contain a threaded screw or bolt in its upper portion, as shown in transition in FIG. 3. Ankle 32 may have a threaded insert or nut on its lower portion that may be threaded onto a screw or bolt on the upper portion of foot 16, to detachably and pivotably connect it to foot 16, as shown in transition in FIG. 3. FIG. 4 shows leg 8 detachably connected to platform section 4 by screw 6 on its upper end and detachably connected to ankle 32 on its lower end, which, in turn, is detachably connected to foot 16. On its bottom end, leg 8 may alternatively be detachably connected directly to foot 16 without the use of ankle 32, if there is no need to pivot foot 16 at an angle (e.g., if placed on a relatively straight surface); or it may not be connected to a foot or an ankle at all and may be caused to simply rest its lower end on a surface. Alternatively screw 6 may be detachably connected directly to foot 16 (e.g., through a female to female adapter), without the use of leg 8. The example of detachably connecting a screw, platform section, leg, ankle, and foot as shown in transition in FIG. 3 and shown fully connected in FIG. 4 is applicable to any combination of: screws 6; sections 4; legs 8, 10, and 12; ankles 32; and feet 14, 16, 18, 20, 22, 24, 26, 28, and 30. As mentioned previously and shown in FIG. 1, legs 10 and 12 may contain the same or similar features as leg 8, particularly where each may connect to a screw on its upper end, where each may contain an intermediary height adjustment mechanism, and where each may connect to an ankle or foot on its lower end, which may allow each of legs 10 and 12 to detachably and interchangeably connect to each of sections 4, screws 6, ankles 32, feet 14-30, and/or other components in the same way leg 8 may be connected to those components, which is shown by way of example in FIGS. 3 and 4. Similarly, each of feet 16-30 may contain some of the same features as foot 14, particularly the threaded screw or bolt in its upper portion which may be the same as or similar to the threaded screw or bolt of foot 14, allowing each of feet 16-30 to be detachably and interchangeably connected to ankles 32, directly to any of legs 8-10, directly to screws 6 (e.g., which may allow a foot to be connected to sections 4 of platform 2 without the need for a leg), or to other components, as shown by way of example in FIGS. 3 and 4.

Figure 5:
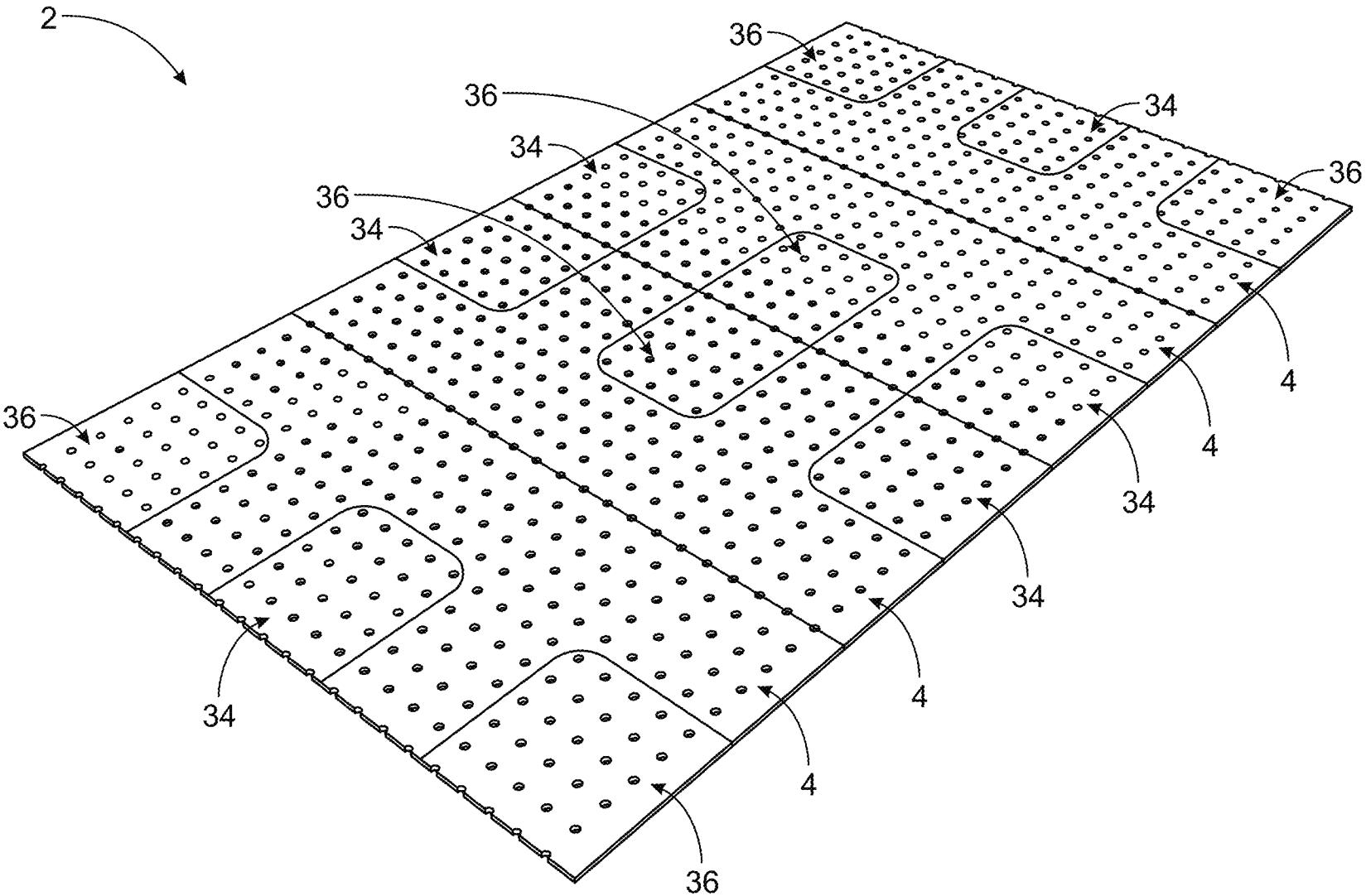
FIG. 5 shows a perspective view of the sections of a platform of an exemplary bed system with stickers to guide leg placement for assembly.

As previously mentioned, several combinations of screws, legs, ankles, and feet, or portions with no attachments at all may be used to position platform 2 above, on, or around objects, inside structures, or outside. Numerous holes or receptacles in sections 4 of platform 2 may offer numerous locations for leg placement and/or foot placement. Stickers placed on each section 4 of platform 2 may serve as a guide in determining optimal placement of a leg and/or foot, and/or other non-attached support such as a hard cooler, or vehicle seat back or bottom so that elevated bed system 1 is sufficiently supported. Stickers 34 and 36 may contain holes that correspond with the holes in each section 4 that it may be placed on or attached to, in such a way that it may not interfere with the normal functioning of section 4 or normal attachment of components to section 4. As shown in FIG. 5, by way of example, stickers 34 and 36 may each offer possible combinations of leg, foot, and/or other support locations for platform 2. For example, at least one leg, foot, and/or ankle combination, and/or other non-attached support placed roughly where all of stickers 34 are might offer one suitable support regime; and at least one leg, foot, and/or ankle combination, and/or other non-attached support placed roughly where all of stickers 36 are might offer an alternate support regime. Other stickers that offer more or different support regimes may also be considered, and the number, placement, and shape of stickers may be determined by the thickness and strength of platform 2, the thickness and strength of legs, feet, and/or other supports, and/or several other factors. Stickers 34 and 36 may be comprised of paper, plastic, vinyl, adhesive, and/or a combination of materials.

Figure 6:
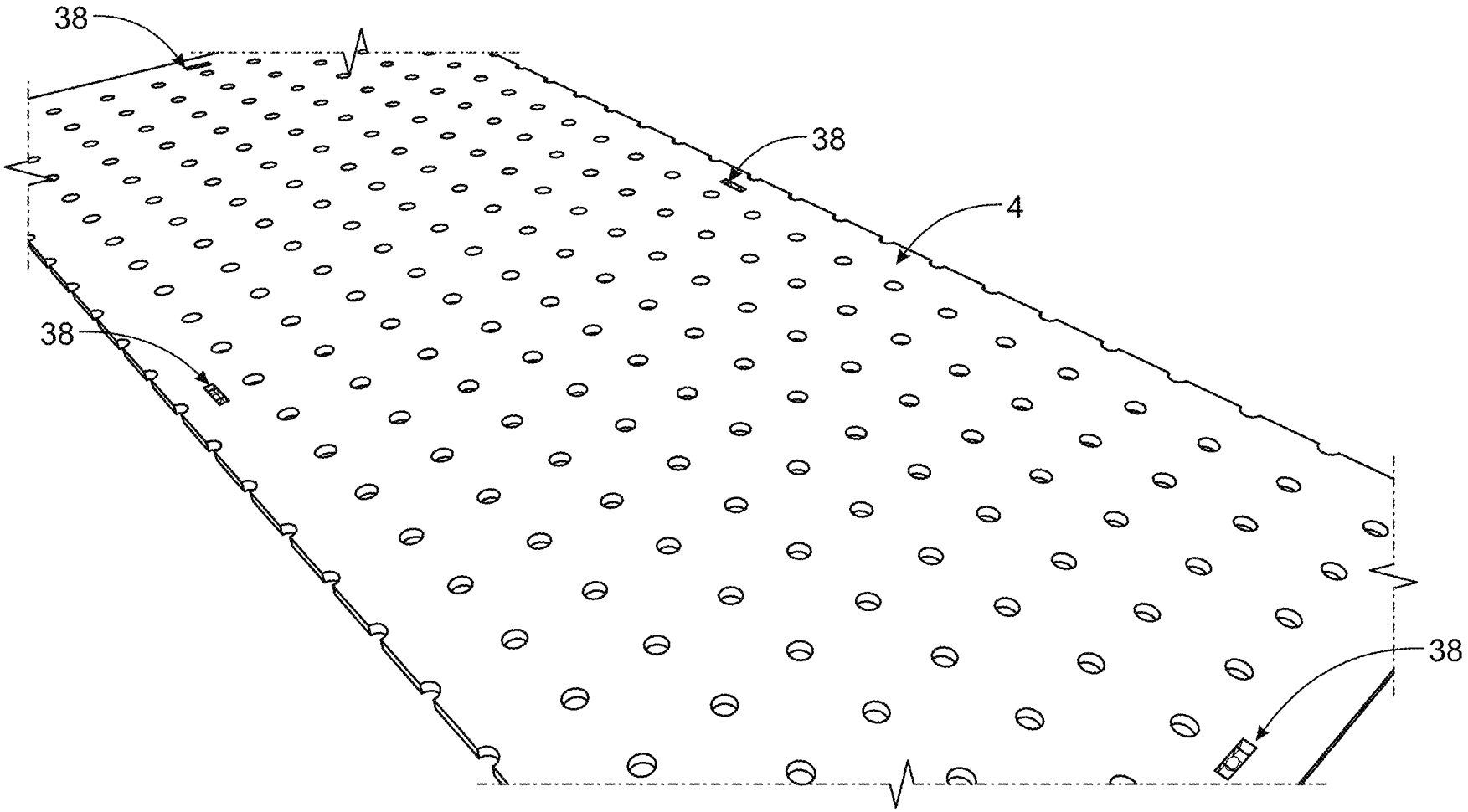
FIG. 6 shows a perspective view of a section of a platform of an exemplary bed system with bubble levels to aide leveling of the platform for assembly.

To further aid assembly of elevated bed system 1, bubble level 38 which may exist on one or more sides of each section 4 of platform 2, as shown in FIG. 6 may allow more accurate leveling of platform 2 to create a level sleeping surface. When one or more of sections 4 that may make up platform 2 are placed on supports, bubble level 38 may be used to further refine support placement or height adjustment to ensure a level platform. For example, some combination of screws and legs: screws and feet; screws, legs, and feet; screws, legs, feet, and ankles; and/or other attachable or non-attached supports may be adjusted to an initial setting, for attachment to one or more of sections 4 of platform 2, then after checking one or more of bubble levels 38, if not level, the supports may be readjusted or repositioned (e.g., by readjusting leg height, ankle angle, and/or choice of foot, or by moving, removing, and/or adding components or non-attached supports), if necessary, to further level platform 2 for use.

Figure 7:
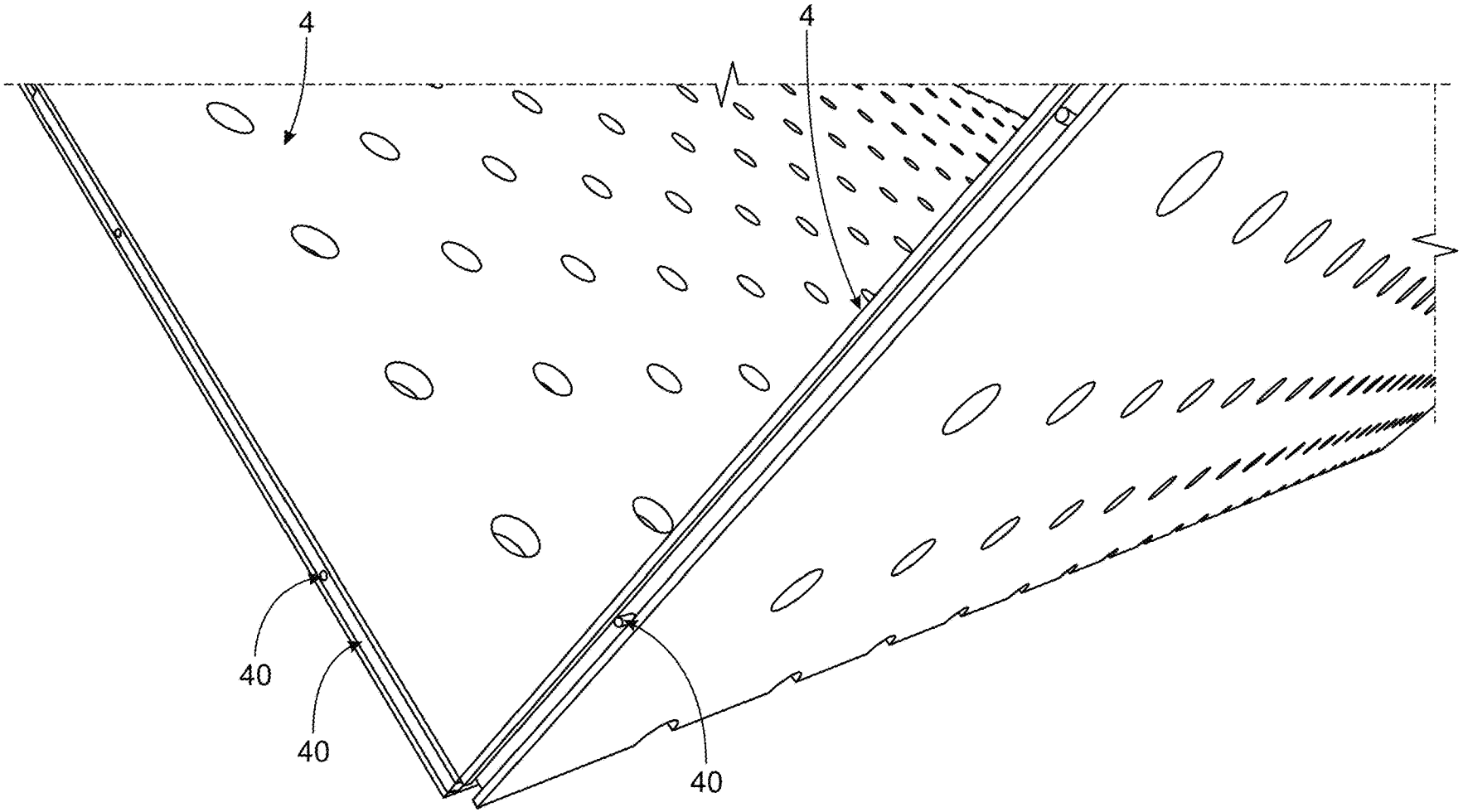
FIG. 7 shows a perspective view of two sections of a platform of an exemplary bed system with a slide latch between them in transition of being unfolded and latched.
Figure 8:
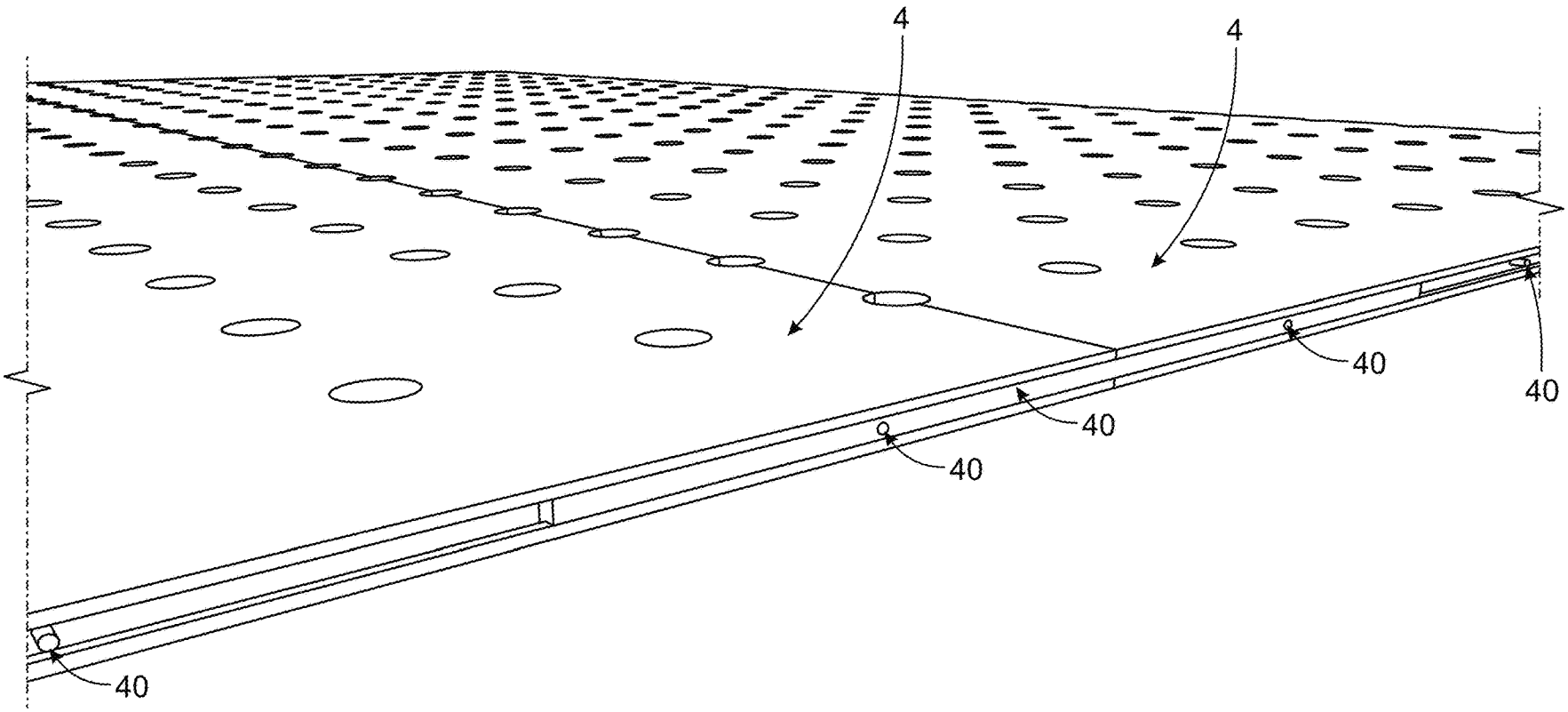
FIG. 8 shows the sections of a platform of the exemplary elevated bed system of FIG. 7 in an unfolded and latched configuration.

With legs, feet, and/or other supports optimally placed and platform 2 appropriately leveled, adjoining sections 4 may be latched to each other, if necessary. Alternatively, latching of adjoining sections 4 may be done prior to further refinement to level platform 2. Latching may prevent unwanted movement or may increase the holding strength of the unfolded platform 2. FIG. 7 shows latch 40, which may be a sliding latch which may contain a rigid slide or plate that is capable of sliding in and between the C-channels located in the sides of two adjoining sections 4 (or the C-channels may be components of the sliding latch that are permanently or semi-permanently attachable to section 4 sides); and which may contain spring-loaded pins in two adjoining sections 4. FIG. 7 shows two adjoining sections 4 in transition of being unfolded, with certain components of latch 40 located in one of the two sections 4 and other components located in the other of the two sections 4. As shown in FIG. 7, latch 40 may contain spring-loaded pins in a first section 4, holding the slide portion of latch 40 captive in the C-channel located in the first section 4 and latch 40 may also contain spring-loaded pins in a second and adjoining section 4 that may not be holding anything or occupying any hole at the moment, when the two sections 4 are in transition of being unfolded (or folded). As shown in FIG. 8, when the two adjoining sections are unfolded and at about a 180-degree angle relative to each other, one or more spring-loaded pins of latch 40 in a first section 4 may be depressed, freeing the slide portion of latch 40, allowing it to partially move into the C-channel located in a second section 4 until one or more of the spring-loaded pins of latch 40 in the second section 4 pop up, causing one or more of the holes in the slide portion of latch 40 to become occupied by one or more pins of latch 40 located in the second section 4, while one or more holes in the slide portion of latch 40 are still occupied by one or more spring-loaded pins of latch 40 located in the First section 4. In this position, the slide portion of latch 40 is held captive by spring-loaded pins located in two adjoining sections 4 causing these two sections to be latched in an unfolded position which may further strengthen the joint between these sections. To fold the sections, the spring-loaded pins of latch 40 located in a second section 4 may be depressed, freeing the slide portion of latch 40, allowing it to be moved back into the C-channel located in a first section 4 until the spring-loaded pins of latch 40 located in the first section 4 hold it captive, then the two sections 4 are free to fold or separate, as shown in FIG. 7. Slide 40 may be comprised of metal, plastic, composite material, other material, or a combination of materials.

Figure 9:
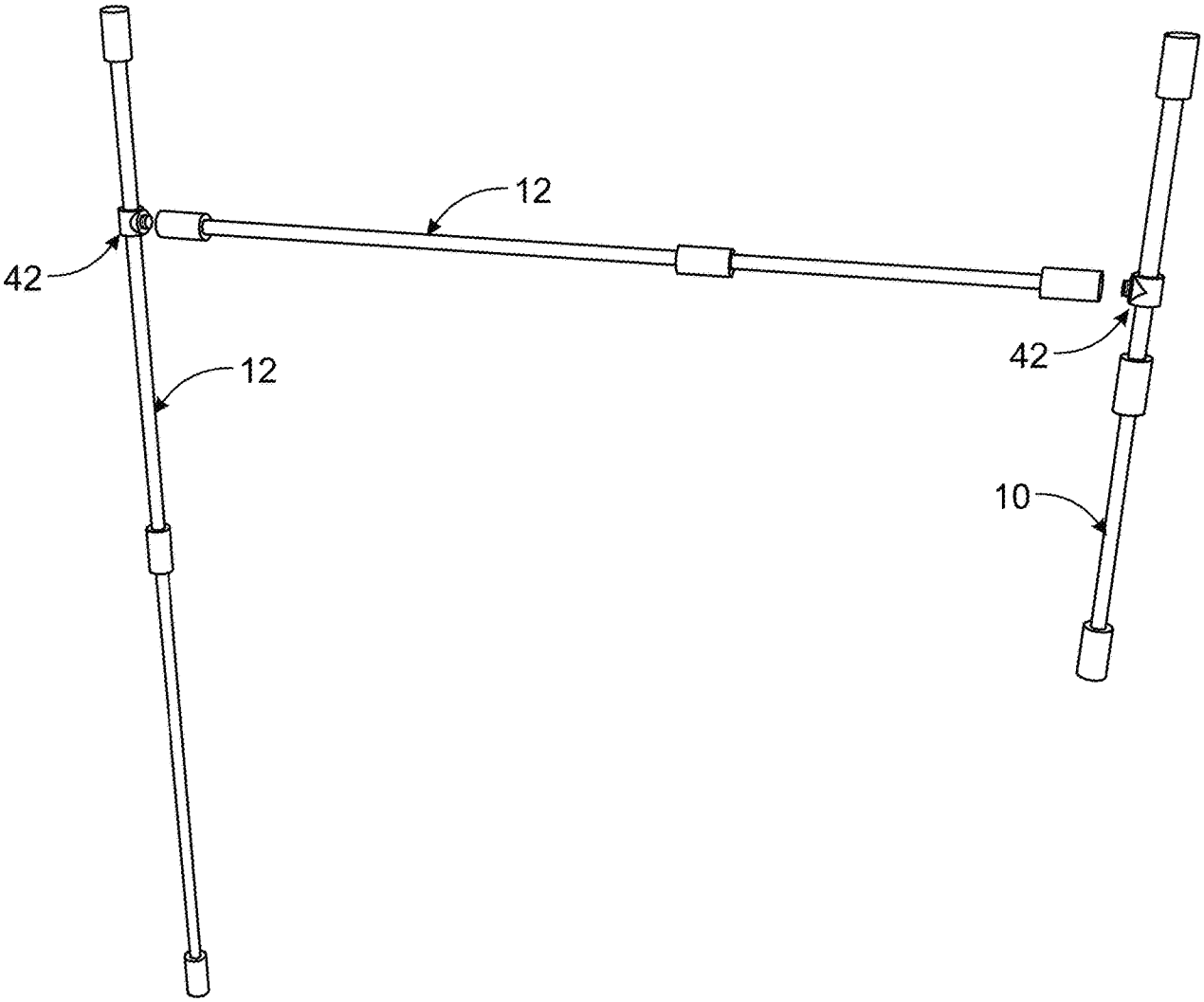
FIG. 9 shows a perspective view of two clamps in transition of being used to detachably connect one leg, configured for use as a cross brace, between two other legs.
Figure 10:
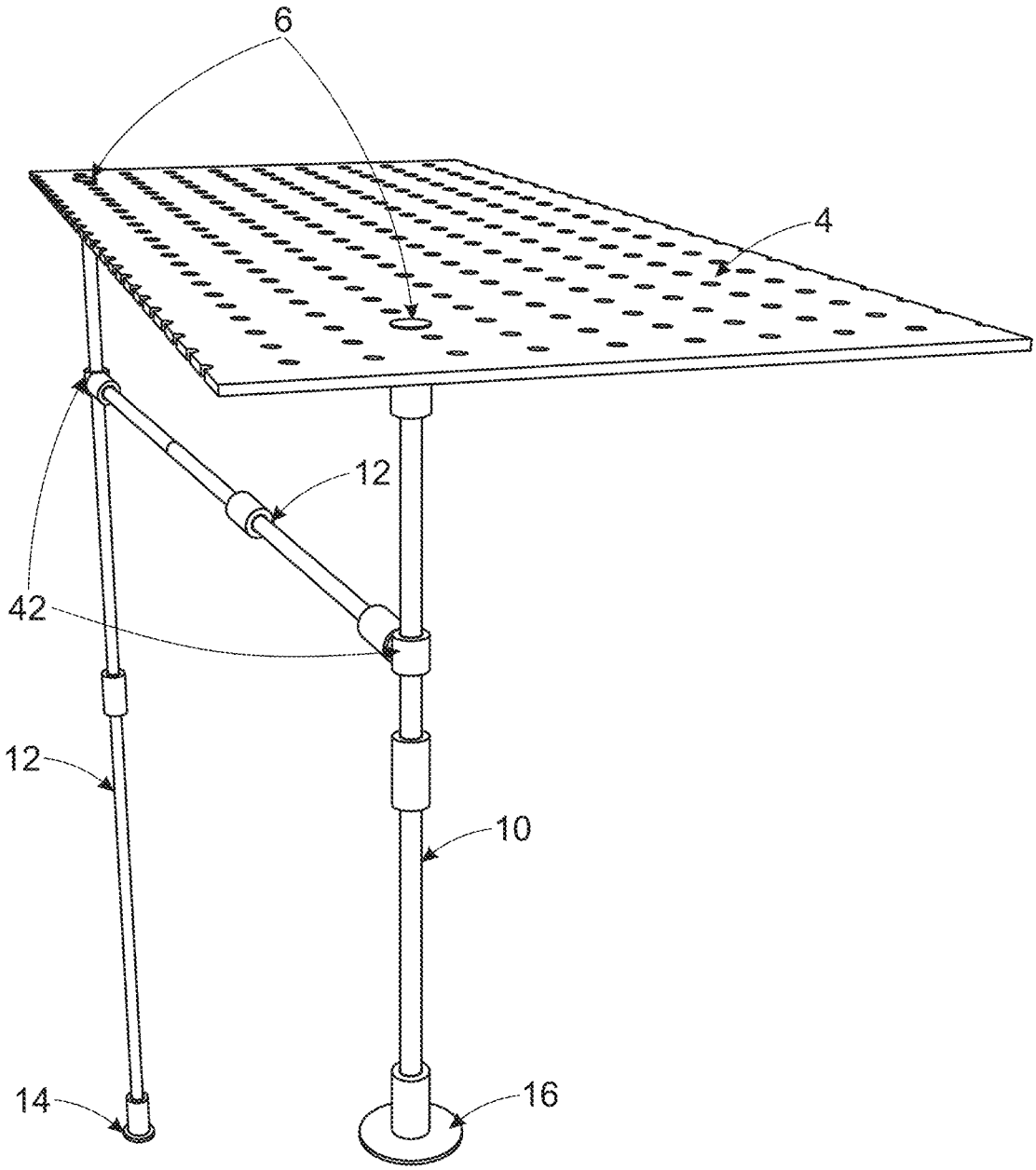
FIG. 10 shows a perspective view of the legs and cross brace of FIG. 9 detachably connected to a platform section by two screws and two legs each detachably connected to a foot.

Certain legs, particularly taller legs, once positioned for use in elevated bed system 1, depending on their adjusted height, may need additional cross-bracing support. For example, leg 12, which may be a tall leg that may require additional cross-bracing to keep it sturdy, particularly if extended to a tall position and platform 2 is in a position where sideways or front and back movement may occur (e.g., it may sway if not confined in an area where it may not move much). Since elevated bed system 1 contains components that are modular, certain components may serve other functions. An otherwise unused leg, for example, may be reconfigured for use as a cross brace rather than a leg. To create additional support for a taller leg, it may be detachably connected to another leg using a cross-brace or support as shown in transition of being assembled in FIG. 9. By using another adjustable height leg as the cross-brace, the cross-brace's length may be adjusted to reach another nearby leg, as shown in FIG. 9. As shown in FIG. 9, clamps 42 may clamp around tall leg 12 and medium or intermediate height leg 10, respectively, and may allow another leg, leg 12, to be positioned between the two clamps 42, as shown in transition. Clamp 42 may be comprised of metal, plastic, composite material, other material, or a combination of materials. FIG. 10 shows leg 12, configured as a cross brace, positioned between another leg 12 and leg 10, and detachably connected to clamps 42, with one of clamp 42 clamped to each of legs 10 and 12. As shown by way of example in FIG. 10, two adjacent legs may be positioned in different rows of holes in section 4. As shown in this example, leg 12 may be detachably connected by screw 6 in a first row of holes of section 4 and leg 10 may be detachably connected by another screw 6 in a third row of holes, such that the two legs are not in the same row. As shown in FIG. 10, each of clamps 42 may be turned so that each points its threaded nut or bolt (as more clearly shown previously in FIG. 9) toward the opposite leg (or toward the threaded portion of the opposite clamp) to connect two legs that are not in line each other (e.g., not positioned in the same row or column of holes). As shown in FIG. 10, clamp 42 on leg 12 may be positioned to point toward clamp 42 on leg 10 and another leg 12 may be detachably connected to both clamps 42 to secure leg 12 to leg 10, for cross-bracing purposes. Similarly, depending on the height of one or more legs positioned for use and their distance to nearby legs that are also positioned for use, one of legs 8, 10, or 12 may be detachably connected to a second one, of nearby legs 8, 10, or 12 by configuring a third one of legs 8, 10, or 12 as a cross-brace, if needed. Alternatively, a clamp 42 clamped to one of legs 8-12 that may be positioned for use and may require additional bracing may also be detachably connected to a first ankle 32 which may then be detachably connected to second leg (e.g., second one of legs 8-12) or other support, which may then be positioned at an angle and detachably connected to a second ankle 32 which may then be detachably connected to a screw 6 passed through a hole section 4. This alternative method of adding additional bracing involves two legs (or one leg and one support) rather than three legs (or two legs and one cross-brace), where the second leg is configured for use an angled brace where it is detachably connected to the first leg and detachably connected to a section 4 of platform 2, rather than to a third leg.

Once platform 2 of elevated bed system 1 is detachably connected to legs, ankles, and/or feet, or caused to rest on sufficiently supportive objects, mattress 44 may be unfolded and placed on top of platform 2, as previously shown in transition in FIG. 2. As shown in FIG. 2, mattress 44 may be foldable into sections similar in width and length to sections 4 of platform 2 and, when unfolded, mattress 44 may be similar in width and length to platform 2 when it is in an unfolded configuration. Alternatively, any mattress (e.g., a non-foldable mattress, an inflatable mattress, or any other type of mattress) may be placed on an appropriately supported and leveled platform 2 for use with elevated bed system 1.

Figure 12:
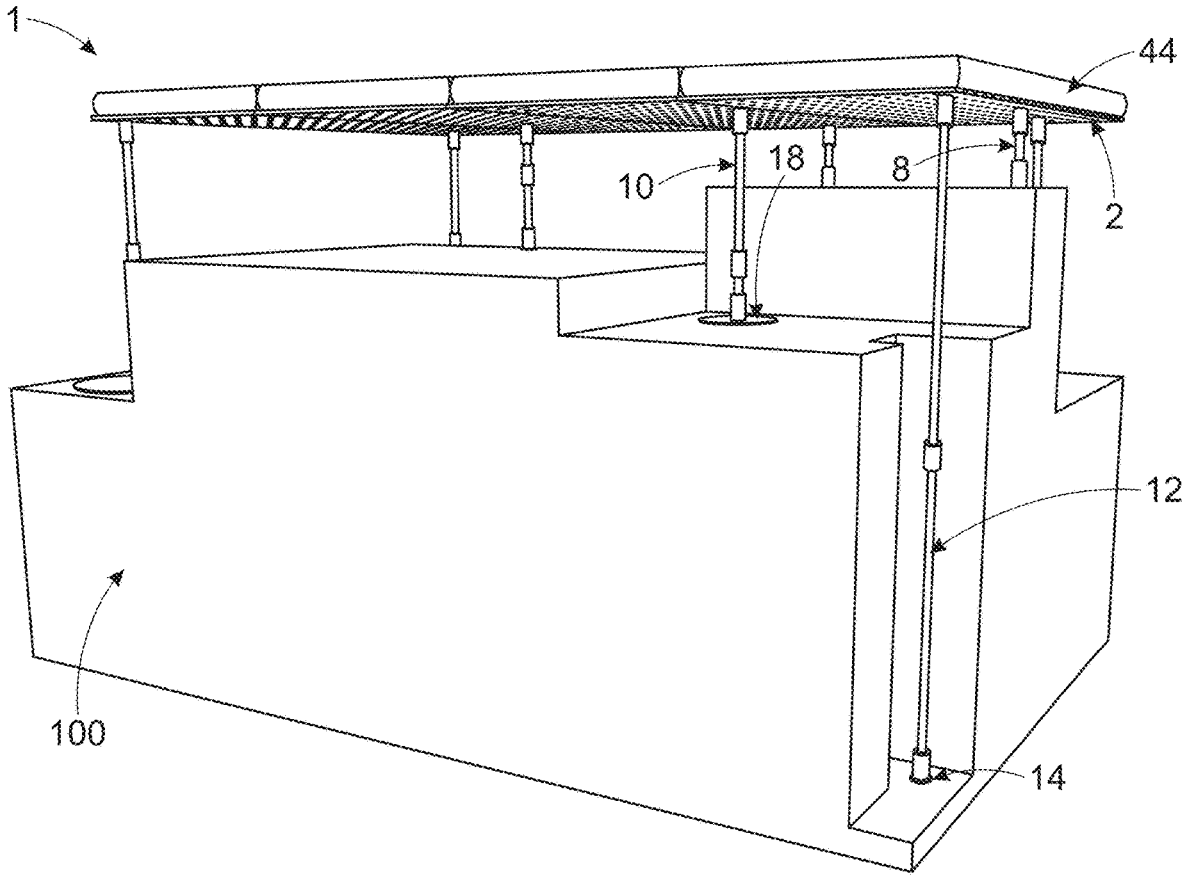
FIG. 12 shows a right, rear perspective view of the exemplary elevated bed system and surface of FIG. 11.

FIGS. 11 and 12 show elevated bed system 1 fully assembled for use on an exemplary surface, surface 100, which may contain portions that are uneven in height and may contain portions that are sloped or slanted at various angles. FIG. 11 shows a left, front perspective view of elevated bed system 1 on surface 100. As shown in FIG. 11, mattress 44 may rest on platform 2 which may be detachably connected to an assortment of legs adjusted to various heights, that may be detachably connected to an assortment of feet, where some legs and feet may have ankles detachably connected between them, such that elevated bed system 1 may rest on surface 100, portions of which may be uneven and/or sloped. As shown in FIG. 11, beginning from the left: medium-height leg 10 may be adjusted to rest on a relatively medium-depth, flat portion of surface 100, as compared with other portions of surface 100, and may be detachably connected to medium-sized foot 16; short leg 8 may be adjusted to rest on a relatively shallow, sloped portion of surface 100, as compared with other portions of surface 100, and may be detachably connected to ankle 32, which may be detachably connected to medium-sized foot 16; medium-height leg 10 may be adjusted to rest on a relatively shallow, flat surface of surface 100, as compared with other portions of surface 100, and may be detachably connected to small foot 14; medium-height leg 10 may be adjusted to rest on a relatively medium-depth, sloped portion of surface 100, as compared with other portions of surface 100, and may be detachably connected to ankle 32, which may be detachably connected to extra-large foot 20; and medium-height leg 10 may be adjusted to rest on a relatively medium-depth, flat portion of surface 100, as compared with other portions of surface 100, and may be detachably connected to extra-large foot 20. FIG. 12 shows a right, rear perspective view of elevated bed system 1 and surface 100 shown in FIG. 11. As shown in FIG. 12, beginning from the left: medium-height leg 10 may be adjusted to rest on a medium-depth, flat portion of surface 100, as compared with other portions of surface 100, and may be detachably connected to large foot 18; tall leg 12 may be adjusted to rest on a relatively deep, flat portion of surface 100, as compared with other portions of surface 100, and may be detachably connected to small foot 14; and short leg 8 may be adjusted to rest on a relatively shallow, flat portion of surface 100, as compared with other portions of surface 100 without either a foot or an ankle detachably connected to it. The leg, ankle, and/or foot combinations shown in FIGS. 11 and 12 are shown as exemplary combinations used to place elevated bed system 1 on an exemplary surface, however, any of legs 8-12; feet 14-30; and ankle 32, if needed, may be combined to be placed on a variety of other surfaces, flat or sloped, soft or hard, or with other, different attributes as mentioned previously.

Elevated bed system 1 may be deployed over a relatively even surface as well, such as a level ground at a camp site or on another relatively even surface inside or outside, using a plurality of relatively evenly adjusted legs and similar detachably connected feet. FIG. 13 shows mattress 44 resting on platform 2 which may be detachably connected to a sufficient number of legs 10, adjusted to relatively the same height, and each detachably connected to a foot 16. Whether elevated bed system 1 is deployed over an uneven surface as previously shown in FIGS. 11 and 12 or over a relatively even surface as shown in FIG. 13, it may also be configured to be used as a tent cot, with a tent cover detachably connected to platform 2. As shown in FIG. 14, a tent cover may be detachably connected to the elevated bed system of FIG. 13, by way of example. As shown in FIG. 14, mattress 44, which may rest on platform 2, which may be detachably connected to a sufficient number of legs 10, each of which may be detachably connected to a foot 16, may be covered by tent 46, which may be similar to a typical tent (e.g., comprised of tent material such as canvas, nylon, other waterproof or water-resistant material, or a combination of materials) and erected using typical tent poles (e.g., that may be comprised of aluminum, plastic, shock-cord, other material, or a combination of materials), except that the tent poles or portions of tent 46 may be detachably connected to platform 2, using the same screws or similar screws or other attachment mechanisms used to detachably connect legs and feet to platform 2. For example, screw 6 may be passed through holes in one or more sections of platform 2 from the bottom surface of the platform (e.g., as opposed to from the top surface of the platform to detachably connect legs and feet, for example) to detachably connect tent poles of tent 46 (e.g., the screws may be screwed into threaded inserts at the bottom of the tent poles), or to other portions of tent 46, securing tent 46 to platform 2. Tent 46 may fully enclose the sleeping area of elevated bed system (e.g., the mattress and the area above the mattress) thereby configuring elevated bed system 1 for use as a tent cot, which may be an enclosed shelter elevated above the ground.

Figure 15:
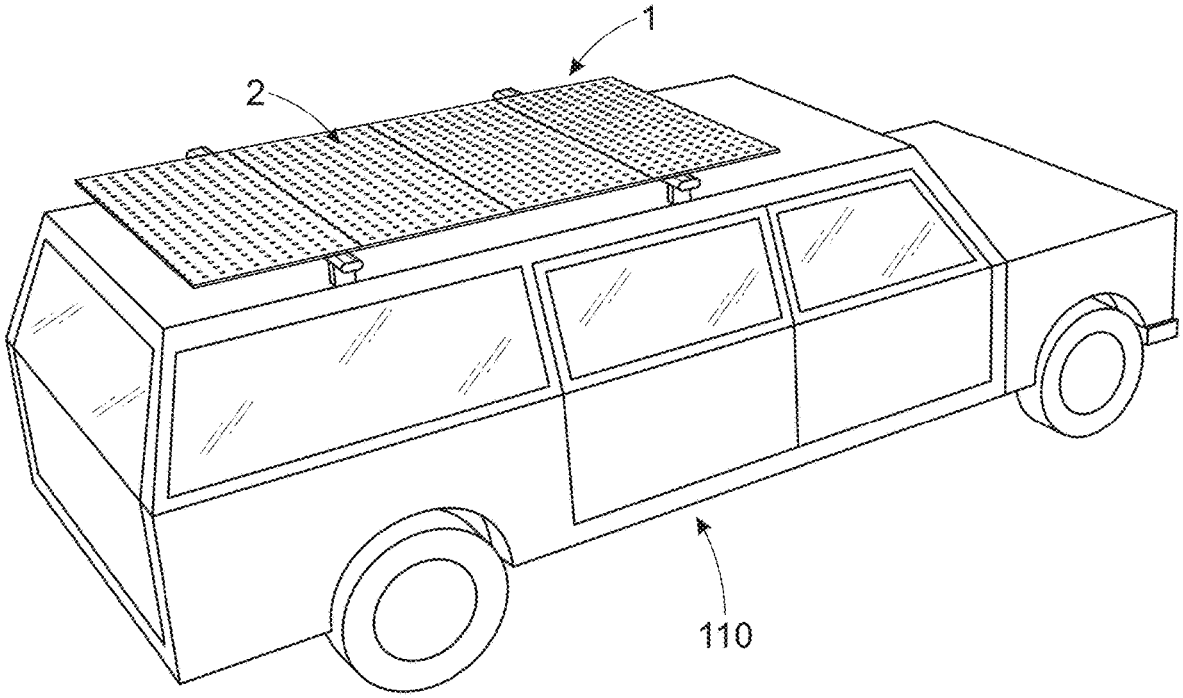
FIG. 15 shows a perspective view of an exemplary elevated bed system configured as a roof rack on an exemplary SUV.

Elevated bed system 1 may be configured for use as a platform roof rack on a vehicle, such as exemplary SUV (Sport Utility Vehicle) 110, as shown in FIG. 15. Platform 2 may be detachably connected to a sufficient number (e.g., 1 to 4 or more or less) of both screw 6 and foot 30 (not visible in FIG. 15), which may be a bracket attachable to or around the roof rack cross bars on SUV 110. In this configuration, elevated bed system 1 may be used to store items on top of SUV 110, while in transit, which may be strapped around platform 2 or strapped to or through the holes in platform 2. To reconfigure the elevated bed system shown in FIG. 15 for use as a rooftop tent when the vehicle is parked, tent 46 may be detachably connected to platform 2, as described above and as shown in FIG. 16, and a mattress, such as mattress 44, may be placed inside.

Elevated bed system 1 may be configured for use as a bed cover or bed rack for a pickup truck, such as truck 120. Platform 2 may be detachably connected to a sufficient number of screws and legs: screws and feet: screws, legs, and feet; screws, legs, feet, and ankles; and/or other attachable or non-attachable supports (e.g., wheel wells) inside the bed of exemplary truck 120, as shown in FIG. 17 (with the leg supports shown more clearly in FIG. 18 by way of example, where some of leg 10*s* are shown detachably connected to platform 2 and detachably connected to feet 16 to support platform 2 on or above the bed of truck 120). In this configuration, elevated bed system 1 may be tied down to truck 120's tie down hooks and locked, if necessary, with a cable lock, for example, configuring it for use as a bed cover and/or bed rack. Items may then be secured under platform 2 of elevated bed system 1 or may be secured to the top of platform 2 by being strapped around platform 2, or strapped to or through the holes in platform 2 when truck 120 is in transit. To reconfigure the elevated bed system shown in FIG. 17 for use as a truck bed tent when the vehicle is parked, tent 46 may be detachably connected to platform 2, as described above and shown in FIG. 18, with a mattress, such as mattress 44, placed inside.

Portions of elevated bed system 1 may also be configured for use as shelving (e.g., inside a vehicle trunk). One or more of section 4 may be detachably connected to enough legs and/or feet such that items may be stored on section 4 and/or below it. If additional shelves are desired, enough legs may be detachably connected between two independent sections 4 (i.e., two of section 4 that are not joined by hinges or are separable) (e.g., a leg may be detachably connected on the top to a section 4 by screw 6 and on the bottom to another section 4 and another screw 6, such that one or more legs detachably connected in this way may support one shelf above another). One or more sections 4 of elevated bed system 1 may be deployed in the trunk and used as shelving, if elevated bed system 1 is not in use as a bed, while one or more other sections 4 may remain folded or detached, and may be unfolded or attached for use as a bed, when needed (e.g., one or more of section 4 may be unfolded and detachably connected to legs for use as a shelf, while an additional one or more of sections 4 remains folded or detached and can be unfolded or attached with a mattress placed on top to reconfigure elevated bed system 1 for use as a bed).

When not in use, the detachable components of elevated bed system 1 may be detached, compressed, and/or folded for storage. Each section 4 of platform 2 may be folded and/or separated and stacked as shown in FIG. 1. Each screw 6, leg 8, leg 10, leg 12, foot 14, foot 16, foot 18, foot 20, foot 22, foot 24, foot 26, foot 28, foot 30, ankle 32, and clamp 42 may be detached, as shown in FIG. 1, and stored. Mattress 44 may be folded, as shown in FIG. 1. Tent 46 may be compressed, folded, and/or rolled as shown in FIG. 1. Some or all components of elevated bed system 1 may be stored and organized into one or more storage cases to make elevated bed system 1 easily portable inside a vehicle trunk, on top of a vehicle roof rack, in a pickup truck bed, and/or transported in other ways.

What is claimed is:

1. An elevated bed system comprising:

a perforated platform;

a leg detachably connected to a side of the perforated platform by an attachment on the other side of the perforated platform, the leg being configured to vary length; and a foot pivotably connected to the leg, the foot being configured to be placed on a surface.

2. The elevated bed system of claim 1, wherein the perforated platform is foldable.

3. The elevated bed system of claim 1 comprising total two legs detachably connected to the perforated platform, each of the legs having different length.

4. The elevated bed system of claim 1 comprising total three legs detachably connected to the perforated platform, each of the legs having different length.

5. The elevated bed system of claim 1, wherein the foot is detachably connected to the leg.

6. The elevated bed system of claim 1, wherein the foot is pivotably connected to the leg by an ankle.

7. The elevated bed system of claim 6, wherein the ankle is detachably connected to the leg.

8. The elevated bed system of claim 7, wherein the ankle is configured to permit the foot to pivot to rest the foot on a sloped or uneven surface.

9. The elevated bed system of claim 1, wherein the foot contains a stake, screw, corkscrew, and a combination thereof on a lower portion of the foot.

10. The elevated bed system of claim 1, wherein the perforated platform comprises a bubble level configured to indicate whether the perforated platform is level, or placement-guiding stickers configured to guide optimal placement of a leg, a foot, or other non-attached supports.

11. The elevated bed system of claim 1, wherein holes of the perforated platform are configured to receive screws that detachably connect the leg to the perforated platform.

12. The elevated bed system of claim 1, wherein the leg is configured to vary length by a screw.

13. The elevated bed system of claim 1, wherein the perforated platform comprises a C-channel located along an edge of a section of the perforated platform, and a latch slidable within the C-channel.

14. The elevated bed system of claim 1, further comprising spring-loaded pins configured to latch adjacent sections of the perforated platform together in a deployed position and unlatch for folding.

15. The elevated bed system of claim 1, further comprising a cross-brace detachably connected between two legs to increase lateral stability of the perforated platform.

16. The elevated bed system of claim 15, wherein the cross-brace is connected to the legs by clamps and is length-adjustable.

17. The elevated bed system of claim 1, wherein the foot is round.

18. The elevated bed system of claim 1, wherein the foot is a bracket configured to attach to a roof rack cross bar of a vehicle.

19. The elevated bed system of claim 1, wherein at least one tent pole is detachably connected to the perforated platform using the holes.

20. The elevated bed system of claim 19, further comprising a tent attached to the at least one tent pole.

* * * * *